US005278039A

United States Patent [19]

Seto et al.

[11] Patent Number: 5,278,039

[45] Date of Patent: Jan. 11, 1994

[54] SILVER HALIDE COLOR PHOTOGRAPHIC MATERIAL CONTAINING AN ANTI-FACING AGENT

[75] Inventors: Nobuo Seto; Hiroshi Fukuzawa; Masakazu Morigaki, all of Kanagawa, Japan

[73] Assignee: Fuji Photo Film Co., Ltd., Kanagawa, Japan

[21] Appl. No.: 865,333

[22] Filed: Apr. 8, 1992

[30] Foreign Application Priority Data

Apr. 8, 1991 [JP] Japan ..... 3-101774

[51] Int. Cl.[5] ..... G03C 1/34; G03C 7/36

[52] U.S. Cl. ..... 430/551; 430/556; 430/557

[58] Field of Search ..... 430/551, 556, 557, 607

[56] References Cited

U.S. PATENT DOCUMENTS 4,483,918 11/1984 Sakai et al. ..... 430/372
4,839,264 6/1989 Kida et al. ..... 430/505

FOREIGN PATENT DOCUMENTS 63-161446 7/1988 Japan .
2-34843 2/1990 Japan .
1540255 2/1976 United Kingdom .

*Primary Examiner*—Lee C. Wright
*Attorney, Agent, or Firm*—Sughrue, Mion, Zinn, Macpeak & Seas

[57] ABSTRACT

There is disclosed a silver halide color photographic light-sensitive material capable of providing a color image which does not discolor for a long period of time and having a high preservation property. The light-sensitive material contains a novel anti-fading agent represented by following Formula (I):

wherein $R_1$ represents a hydrogen atom, an aliphatic group, an aromatic group, a heterocyclic group, or an aliphatic oxy group; $R_2$ and $R_3$ may be the same or different and each represent an aliphatic group, an aromatic group, and a heterocyclic group; $R_4$ represents a substituent; $R_5$, $R_6$, $R_7$, $R_8$ and $R_9$ each represent a hydrogen atom and a substituent; $R_2$ and $R_3$, $R_3$ and $R_4$, and $R_4$ and $R_2$ may be combined with each other to form a 5- to 8-membered ring, and a dimer or other polymer may be formed with $R_1$, $R_2$, $R_3$ and $R_4$; $R_5$ and $R_6$, $R_6$ and $R_7$, $R_7$ and $R_8$, and $R_8$ and $R_9$ may be combined with each other to form a 5- to 8-membered ring; provided that $R_5$, $R_6$, $R_7$, $R_8$ and $R_9$ each does not represent an unsubstituted amino group or an unsubstituted carbamoyl group, $R_5$ and $R_9$ each do not represent an aliphatic oxy group, and any one of $R_2$, $R_3$ and $R_4$ does not form a ring with $R_5$, $R_6$, $R_7$, $R_8$ or $R_9$.

14 Claims, No Drawings

SILVER HALIDE COLOR PHOTOGRAPHIC MATERIAL CONTAINING AN ANTI-FACING AGENT

FIELD OF THE INVENTION

The present invention relates to a silver halide color photographic light-sensitive material, more specifically to a silver halide color photographic light-sensitive material with which a color image obtained by development processing does not fade or discolor.

BACKGROUND OF THE INVENTION

In general, a silver halide color photographic light-sensitive material has a silver halide emulsion layer which is sensitive to the three primary colors red, green and blue. A color image is reproduced by a method in which the three color formers (couplers) contained in the respective emulsion layers are developed into the colors having complementary color relations with the colors sensitive to the respective light-sensitive layers, a so-called subtractive color process. A color image obtained by subjecting a silver halide color photographic light-sensitive material to photographic processing generally comprises an azomethine dye or an indoaniline dye which is formed by reacting an aromatic primary amine color developing agent with a coupler. The color photographic image thus obtained is not necessarily stable against light, humidity and heat, and storage under a high temperature and humidity conditions results in fading and discoloring of the color image and deteriorates image quality.

Such fading and discoloring of a color image is an almost fatal defect for a recording material. As the methods for removing these defects, the development of a coupler capable of providing a dye having a high fastness, the application of an anti-fading agent, and the application of a UV absorber for preventing the deterioration of an image by UV rays have been proposed.

Among the above measures, the prevention of the deterioration of an image by a UV absorber is very effective. It is known to add to the emulsion, for example, hydroquinones, hindered phenols, catechols, gallic acid esters, aminophenols, hindered amines, chromanols, indanes, ethers or esters obtained by silylating, acylating or alkylating a phenolic hydroxy group of the above compounds, and metal complex compounds.

These compounds are insufficient to meet the requirements of high quality images, though the effects thereof as an anti-fading and discoloring agents for a color image can be recognized. These compounds are unsatisfactory because they change hue, generate fog, cause inferior dispersion, or form fine crystals after the emulsion is coated.

Disclosed in JP-B-47-47245 (the term "JP-B" as used herewith means an examined Japanese patent publication), JP-A-52-150630 (the term "JP-A" as used herewith means an unexamined published Japanese patent application) and JP-A-55-6321, are the cases in which aniline compounds are used for preventing fading and discoloration of a color image. Further, the cases in which the aniline compounds are used for preventing fading and discoloration of a color image obtained from a magenta coupler are disclosed in JP-A-58-105147, JP-A-62-8148, JP-A-62-212652, JP-A-63-95448, JP-A-63-95450, and JP-A-2-34843.

However, the compounds described in the above publications do not sufficiently improve fastness of a color image since they do not adequately prevent fading but cause a high coloring of backgrounds. Further, some of them cause coloring (hereinafter referred to as fog) of an unexposed portion and prevent couplers from developing color, adversely affecting the so-called photographic properties.

Under such circumstances, a technique for controlling fading and discoloration of an image without badly affecting the photographic properties has been desired.

SUMMARY OF THE INVENTION

An object of the present invention is to provide a silver halide color photographic light-sensitive material capable of providing a color image which does not discolor for a long period of time and has a high preservation property.

Another object of the present invention is to provide a silver halide color photographic light-sensitive material which contains a novel anti-fading agent having a sufficient capacity to prevent fading and discoloration of a color image without causing a change of hue, disturbance after color development of a coupler, and fog, but generating no fine crystals after coating.

A further object of the present invention is to provide a silver halide color photographic light-sensitive material which contains an anti-fading agent having an excellent solubility in a high boiling solvent, generating no fine crystals before or after coating, and exerting no adverse effect on the other photographic additives.

A still further object of the present invention is to provide a silver halide color photographic light-sensitive sensitive material which contains an anti-fading agent having an excellent capacity to prevent fading of a color image and prevent an unexposed portion from coloring, without adversely affecting the photographic properties.

As a result of extensive investigation by the present inventors, it has been found that these and other objects of the present invention can be achieved by a silver halide color photographic light-sensitive material comprising a support having provided thereon at least one layer containing at least one compound represented by following Formula (I):

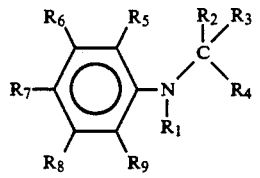

(I)

wherein $R_1$ represents a hydrogen atom, an aliphatic group, an aromatic group, a heterocyclic group, or an aliphatic oxy group; $R_2$ and $R_3$ may be the same or different and each represents an aliphatic group, an aromatic group, and a heterocyclic group; $R_4$ represents a substituent; $R_5$, $R_6$, $R_7$, and $R_8$ and $R_9$ each represents a hydrogen atom or a substituent; $R_2$ and $R_3$, $R_3$ and $R_4$, and $R_4$ and $R_2$ may combine with each other to form a 5- to 8-membered ring; a dimer or other polymer may be formed with $R_1$, $R_2$, $R_3$ and $R_4$; $R_5$ and $R_6$, $R_6$ and $R_7$, $R_7$ and $R_8$, and $R_8$ and $R_9$ may combine with each other to form a 5- to 8-membered ring; provided that $R_5$, $R_6$, $R_7$, $R_8$ and $R_9$ each does not represent an unsubstituted amino group or an unsubstituted carbamoyl group, $R_5$ and $R_9$ each do not represent an aliphatic oxy group, and any one of $R_2$, $R_3$ and $R_4$ does not form a ring with $R_5$, $R_6$, $R_7$, $R_8$ or $R_9$.

The aliphatic group described in the present invention may be linear, branched or cyclic and saturated or unsaturated. It may be, for example, an alkyl, an alkenyl, an alkynyl, a cycloalkyl, or a cycloalkenyl group, which may be further substituted. The aromatic group is an aryl and may have a substituent. The heterocyclic group represents a group having a hetero atom in the ring and includes an aromatic ring. Further, it may have a substituent.

The substituent described herein may be any as long as it is a substitutable group. Examples include an aliphatic group, an aromatic group, a heterocyclic group, an aliphatic acyl group, an aromatic acyl group, an aliphatic acyloxy group, an aromatic acyloxy group, an aliphatic acylamino group, an aromatic acylamino group, an aliphatic oxy group, an aromatic oxy group, a heterocyclic oxy group, an aliphatic oxycarbonyl group, an aromatic oxycarbonyl group, a heterocyclic oxycarbonyl group, an aliphatic carbamoyl group, an aromatic carbamoyl group, an aliphatic sulfonyl group, an aromatic sulfonyl group, an aliphatic sulfamoyl group, an aromatic sulfamoyl group, an aliphatic sulfonamide group, an aromatic sulfonamide group, an aliphatic amino group, an aromatic amino group, an aliphatic sulfinyl group, an aromatic sulfinyl group, an aliphatic thio group, an aromatic thio group, an aliphatic sulfamoylamino group, an aromatic sulfamoylamino group, a mercapto group, a hydroxy group, a cyano group, a nitro group, a hydroxyamino group, an aliphatic sulfonyloxy group, an aromatic sulfonyloxy group, an aliphatic carbamoylamino group, an aromatic carbamoylamino group, and a halogen atom.

The compounds represented by Formula (I) will be described in more detail.

In Formula (I), $R_1$ represents a hydrogen atom, an aliphatic group (for example, methyl, isobutyl, octyl, dodecyl, benzyl, phenethyl, dodecyloxyethyl, allyl, vinyl, cyclohexyl, secondary butyl, and ethoxycarbonylethyl), an aromatic group (for example, phenyl and naphthyl), a heterocyclic group (for example, 4-morpholino and 2-morpholino), and an aliphatic oxy group (for example, methoxy, t-butoxy, octyloxy, dodecyloxy, benzyloxy, allyloxy, cyclohexyloxy, and ethoxycarbonyloxy); $R_2$ and $R_3$ may be the same or different and each represents an aliphatic group (for example, methyl, ethyl, isopropyl, dodecyl, ethoxyethyl, and benzyl), an aromatic group (for example, phenyl 4-methoxyphenyl and naphthyl), and a heterocyclic group (for example, tetrahydropyranyl and 4-pyridyl); $R_4$ represents a substituent; and $R_5$, $R_6$, $R_7$, $R_8$ and $R_9$ each represents a hydrogen atom or a substituent.

Among the compounds represented by Formula (I), preferred are the compounds in which $R_1$ is a hydrogen atom or an aliphatic group, in terms of the objects of the present invention.

More preferred are the compounds in which $R_1$ is an alkyl group having 1 to 20 carbon atoms (preferably, an unsubstituted n-alkyl group or substituted n-alkyl group having as a substituent an alkoxycarbonyl group, an aryloxycarbonyl group, an alkoxy group, an aryloxy group, an aryl group, an alkylcarbamoyl group, an arylcarbamoyl group, an alkylacylamino group, an arylacylamino group, an alkylsulfonyl group, an arylsulfonyl group, an alkylsulfonamido group, an arylsulfonamido group, an alkylthio group, an arylthio group, or a hydroxy group) or an alkenyl group having 2 to 20 carbon atoms (preferably, an unsubstituted n-alkenyl group or substituted n-alkenyl group substituent which is the same as that of the alkyl group described above). The above described carbon numbers include those of the substituent.

Particularly preferred are the compounds in which $R_1$ is an alkyl group having 1 to 20 carbon atoms (preferably, an unsubstituted n-alkyl group or substituted n-alkyl group having as a substituent an alkoxycarbonyl group, an aryloxycarbonyl group, an alkoxy group, an aryloxy group, an aryl group, an alkylcarbamoyl group, an arylcarbamoyl group, an alkylacylamino group, an arylacylamino group, an alkylsulfonyl group, an arylsulfonyl group, an alkylsulfonamido group, an arylsulfonamido group, an alkylthio group, an arylthio group, or a hydroxy group).

Most preferred are the compound in which $R_1$ is an unsubstituted n-alkyl group having 1 to 20 carbon atoms.

Among the compounds represented by Formula (I), preferred are the compounds in which $R_2$ and $R_3$ each is an aliphatic group or an aromatic group, and more preferred are the compounds in which $R_2$ and $R_3$ each is an alkyl group having 1 to 20 carbon atoms and particularly preferred are the compounds in which $R_2$ and $R_3$ each is an unsubstituted alkyl group having 1 to 9 carbon atoms, in terms of the objects of the present invention.

Among the compounds represented by Formula (I), preferred are the compounds in which $R_4$ is an aliphatic group, an aliphatic oxycarbonyl group, an aromatic oxycarbonyl group, an aliphatic carbamoyl group, or an aromatic carbamoyl group, in terms of the objects of the present invention. Of the above substituents, more preferred is an alkyl group having 1 to 20 carbon atoms which may have a substituent as the aliphatic group, and an unsubstituted phenyl group or a substituted phenyl group having 6 to 26 carbon atoms as the aromatic group.

Most preferred are the compounds in which $R_4$ is an alkyl group having 1 to 18 carbon atoms, an alkyloxycarbonyl group having 2 to 18 carbon atoms or a phenylcarbamoyl group having 6 to 20 carbon atoms.

Among the compounds of the present invention represented by Formula (I), preferred are the compounds in which $R_7$ is a hydrogen atom, an aliphatic group, an aliphatic acyloxy group, an aliphatic oxycarbonyl group, an aliphatic thio group, an aromatic thio group, an aliphatic carbamoyl group, an aliphatic sulfonyloxy group, or an aliphatic acylamino group or an aromatic acylamino group in terms of the objects of the present invention. Further preferred are the compounds in which $R_7$ is an alkyl group having 1 to 20 carbon atoms which may have a substituent as the aliphatic group or an unsubstituted phenyl group or a substituted phenyl group having 6 to 26 carbon atoms as the aromatic group.

More preferred are the compounds in which $R_7$ is a hydrogen atom, an alkyl group, an alkylacyloxy group, an alkylthio group, a phenylthio group, a substituted phenylthio group, an alkylsulfonyloxy group, or an alkylacylamino group.

Particularly preferred are the compounds in which $R_7$ is a hydrogen atom, an alkyl group, an alkylacylamino group.

Among the compounds represented by Formula (I), preferred are the compounds in which $R_5$, $R_6$, $R_8$ and $R_9$ are each a hydrogen atom, an aliphatic group, an aliphatic acylamino group, an aromatic acylamino group, an aliphatic oxy group, an aliphatic acyloxy group, an aliphatic sulfonyloxy group, an aliphatic carbamoyl group, a halogen atom, an aliphatic amino group, an aliphatic thio group, an aliphatic oxycarbonyl group, an aromatic thio group, or an aromatic oxy group. Further preferred are the compounds in which $R_5$, $R_6$, $R_8$ and $R_9$ are each an alkyl group having 1 to 20 carbon atoms which may have a substituent as the aliphatic group or a phenyl group and substituted phenyl having 6 to 26 carbon atoms.

The compounds represented by Formula (I) may be used in combination with a known anti-fading agent, and such combined use further increases the anti-fading effect. Similarly, the compounds represented by Formula (I) may be used in a combination of two or more.

The appropriate amount of the compound represented by Formula (I) is different according to the kind of coupler used. The compound is suitably used in the range of 0.5 to 300 mol %, preferably 1 to 200 mol %, based on the amount of the couplers used (preferably, a coupler used in the same layer).

Representative examples of these compounds are shown below, but the compounds used in the present invention are not limited thereto.

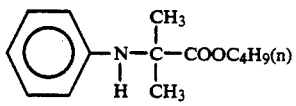
(I-1)

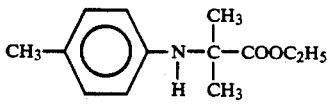
(I-2)

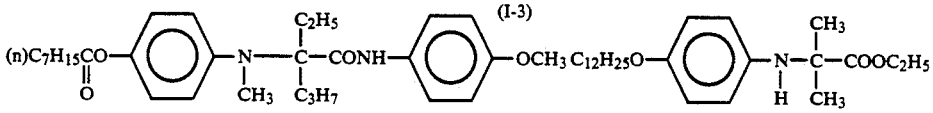
(I-3)

(I-4)

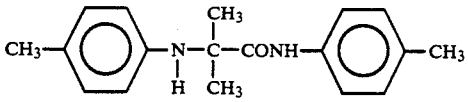
(I-5)

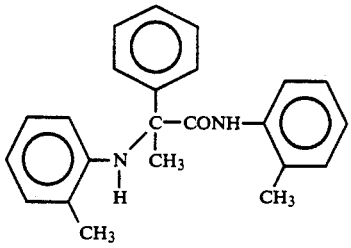
(I-6)

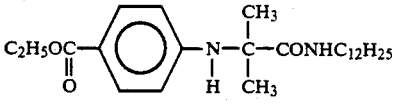
(I-7)

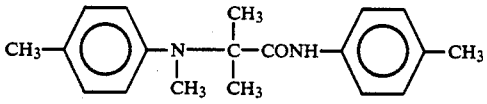
(I-8)

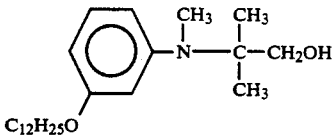
(I-9)

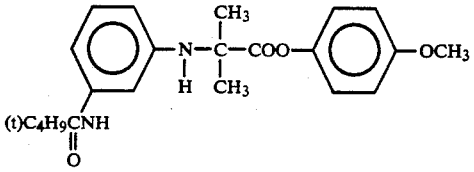
(I-10)

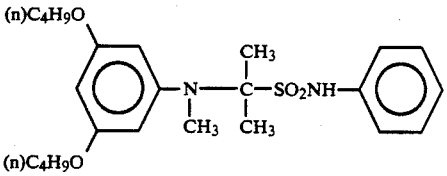
(I-11)

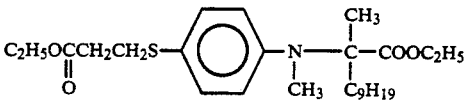
(I-12)

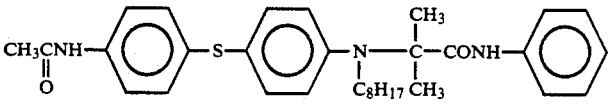
(I-13)

-continued
(I-14)
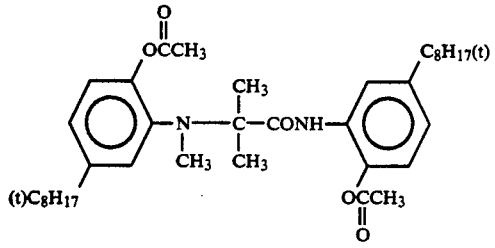
(I-15)
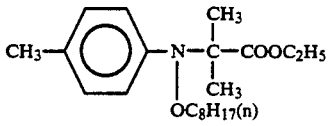
(I-16)
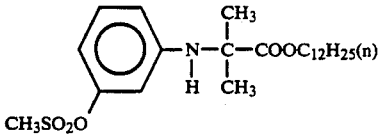
(I-17)
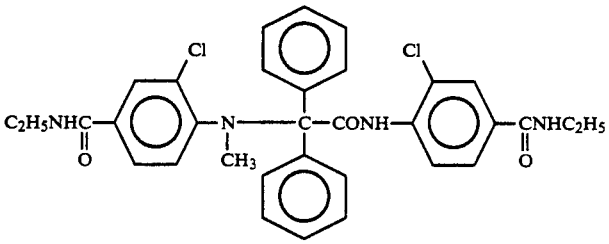
(I-18)
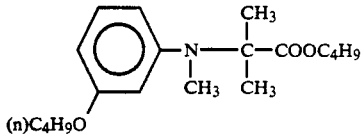
(I-19)
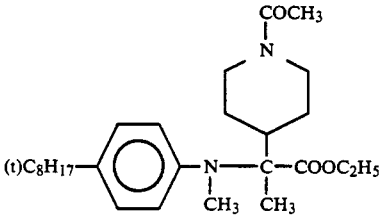
(I-20)
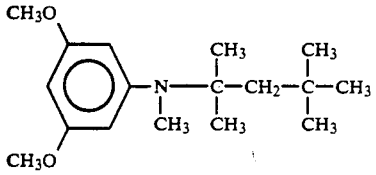
(I-21)
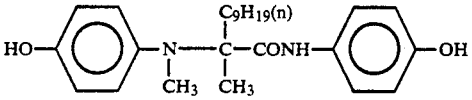
(I-22)
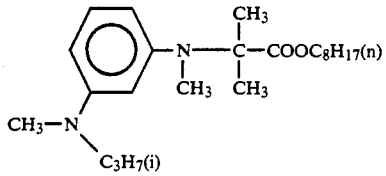
(I-23)
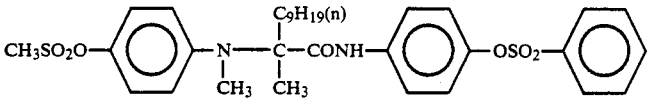
(I-24)
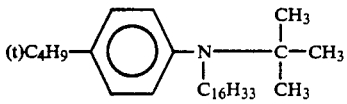
(I-25)
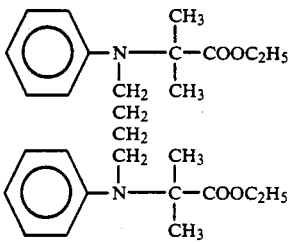

-continued (I-26)

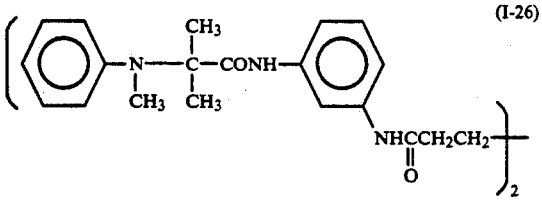

(I-27)

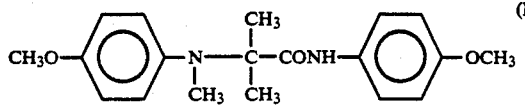

(I-28)

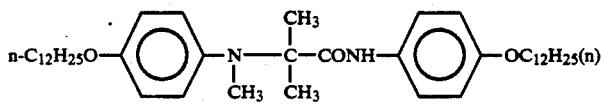

(I-29)

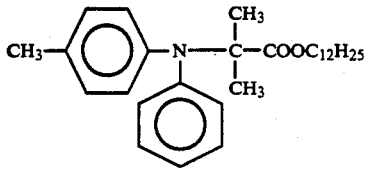

(I-30)

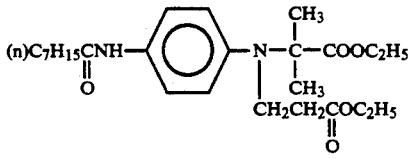

(I-31)

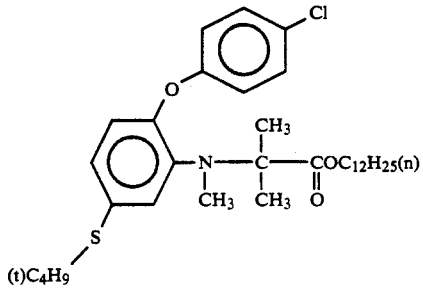

(I-32)

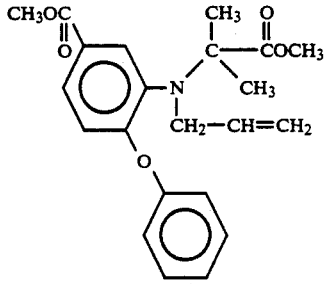

(I-32)

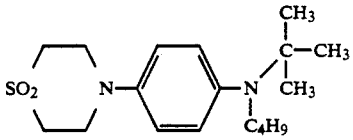

The compounds represented by Formula (I) can be synthesized by various methods. In general, they can be synthesized by conventional N-alkylation with an aniline derivative and alkyl halide. The dimer and polymer forms of the compounds represented by Formula (I) can also be synthesized by the above method in combination with the methods disclosed in JP-A-1-134448 and JP-A-1-134449. Specific synthetic examples of the typical compounds of the present invention are described below. Other compounds represented by Formula (I) may be made according to these methods.

Synthesis of Compound I-2

Para-toluidine (13.6 g, 0.128 mole), potassium carbonate (35.4 g, 0.257 mole) and dimethylacetamide of 50 ml were put in a reaction vessel and heated at an inner temperature of 90° to 95° C. while stirring, and 2-bromo-isobutylic acid (25.0 g, 0.128 mole) was added dropwise to this solution over a period of 20 minutes.

After the reaction was continued for 6 hours, the reaction solution was poured into 200 ml of ice and water and abstracted with 200 ml of ethyl acetate. It was then washed twice with 150 ml of an aqueous sodium chloride solution and dried with anhydrous magnesium sulfate. After filtering magnesium sulfate, ethyl acetate was distilled off under a reduced pressure. An oily substance thus obtained was refined with a silica gel column chromatography to thereby obtain a colorless oily substance. This oily substance was confirmed to be Compound I-2 by a mass spectrum, an NMR spectrum and an infrared spectrum. Yield: 21.0 g (74.3%).

Synthesis of Compound I-5

Para-toluidine (32.6 g, 0.305 mole), chloroform (72.8 g, 0.609 mole), acetone (44.2 g, 0.280 mole), and benzyl trimethylammonium chloride (5.6 g, 0.030 mole) were put in a reaction vessel and heated at an inner temperature of 10° C. while stirring. Then, a solution dissolving sodium hydroxide (65.5 g, 1.64 mole) in 130 ml of water was added dropwise to this solution for 30 minutes.

While adding dropwise, the inner temperature was maintained up to 16° C. At the completion of the dropwise addition, the reaction was continued at an inner temperature of 40° C. or lower for 2 hours. The reaction solution was poured into 500 ml of ice and water and abstracted with 500 ml of ethyl acetate. The abstracted solution was washed with 5 ml of acetic acid and 400 ml of an aqueous sodium chloride solution, followed by further washing with 400 ml of an aqueous sodium chloride solution and drying with anhydrous magnesium sulfate. After filtering magnesium sulfate, ethyl acetate was distilled off under reduced pressure. An oily substance thus obtained was crystallized with 30 ml of ethyl acetate and 160 ml of n-hexane. The crystal thus obtained was recrystallized with 30 ml of ethyl acetate and 90 ml of n-hexane to thereby obtain a white crystal. This crystal was confirmed to be Compound I-5 by a mass spectrum, an NMR spectrum and an infrared spectrum. Yield: 33.5 g (78.0%). Melting point: 123° to 124° C.

Synthesis of Compound I-8

Compound I-5 (15.0 g, 0.051 mole), sodium bicarbonate (8.6 g, 0.102 mole) and dimethylacetamide of 50 ml were put in a reaction vessel and then, methyl iodide (8.7 g, 0.062 mole) was added dropwise to this mixture for 15 minutes while heating and stirring at 40° to 45° C.

After the reaction was continued for one further hour, the reaction solution was poured into 200 ml of ice and water and abstracted with 200 ml of ethyl acetate. It was then washed twice with 150 ml of an aqueous sodium chloride solution and dried with magnesium sulfate anhydrous. After filtering with magnesium sulfate, ethyl acetate was distilled off under a reduced pressure. The substance thus obtained was crystallized with 30 ml of acetonitrile. This crystal was recrystallized with 40 ml of acetonitrile to thereby obtain a white crystal.

This crystal was confirmed to be Compound I-8 with a mass spectrum, an NMR spectrum and an infrared spectrum. Yield: 13.0 g (86.0%). Melting point: 118° to 119° C.

The compound represented by Formula (I) is used particularly preferably in combination with a yellow coupler in the same layer of a light-sensitive material, in terms of the objects of the present invention. It is used further preferably in combination with the yellow couplers described below, particularly preferably in a blue-sensitive silver halide emulsion layer.

The yellow couplers preferably used in the present invention are represented by following Formula (Y):

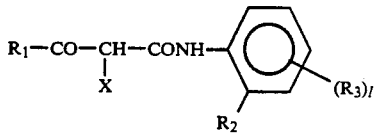

(Y)

wherein $R_1$ represents a tertiary alkyl group, an aryl group, a substituted amino group, or a nitrogen-containing heterocyclic group in which a bonding site is on a nitrogen atom; $R_2$ represents a hydrogen atom, a halogen atom, an alkoxy group, an aryloxy group, an alkyl group, or a dialkylamino group; $R_3$ represents a group which is substitutable on a benzene ring; X represents a hydrogen atom or a group (a splitting off group) capable of splitting off by a coupling reaction with the oxidation product of an aromatic primary amine developing agent; and l represents an integer of 0 to 4, provided that when l is more than one, the plurality of $R_3$ groups may be the same or different.

In the above Formula (Y), examples of $R_3$ include a halogen atom, an alkyl group, an aryl group, an alkoxy group, an aryloxy group, an alkoxycarbonyl group, an aryloxycarbonyl group, a carbonamide group, a sulfonamide group, a carbamoyl group, a sulfamoyl group, a alkylsulfonyl group, an arylsulfonyl group, a ureido group, a sulfamoylamino group, an alkoxycarbonylamino group, a nitro group, a heterocyclic group, a cyano group, an acyl group, an acyloxy group, an alkylsulfonyloxy group, and an arylsulfonyloxy group.

Examples of the splitting-off group represented by X include a heterocyclic group bonded to a coupling active site with a nitrogen atom, an aryloxy group, an arylthio group, an acyloxy group, an alkylsulfonyloxy group, a heterocyclicoxy group, and a halogen atom.

In Formula (Y), $R_1$ is preferably a t-butyl group, a phenyl group, a 1-pyrrolidinyl group, a cyclopropylmethyl group, a cyclopropylethyl group, an indolinyl group, a halogen atom, or a phenyl group substituted with an alkyl group having 1 to 18 carbon atoms or an alkoxy group having 1 to 18 carbon atoms; $R_2$ is preferably a halogen atom, a trifluoromethyl group, an alkoxy group having 1 to 24 carbon atoms, or a phenoxy group having 6 to 24 carbon atoms; $R_3$ is preferably a halogen atom, an alkoxy group having 1 to 30 carbon atoms, an alkoxycarbonyl group having 1 to 30 carbon atoms, a carbonamide group having 1 to 30 carbon atoms, a sulfonamide group having 1 to 30 carbon atoms, a carbamoyl group having 1 to 30 carbon atoms, or a sulfamoyl group having 1 to 30 carbon atoms; X is preferably an aryloxy group having 6 to 18 carbon atoms, or a 5- to 7-membered heterocyclic ring having 2 to 24 carbon atoms bonded to a coupling active site with a nitrogen atom, which may further contain N, S, O or P atoms; and l is preferably an integer of 0 to 2.

In Formula (Y), $R_1$ is preferably a t-butyl group, a cyclopropylmethyl group, a cyclopropylethyl group, or an indolinyl group, most preferably a cyclopropylethyl group or an indolinyl group, in terms of the objects of the present invention.

In Formula (Y), when $R_1$ is a t-butyl group, X is preferably an aryloxy group in terms of the objects of the present invention.

In Formula (Y), $R_2$ is preferably a halogen atom or an alkoxy group having 1 to 18 carbon atoms, particularly preferably an alkoxy group having 1 to 18 carbon atoms, in terms of the objects of the present invention.

The coupler represented by Formula (Y) may be a dimer or a higher polymer than a dimer, a homopolymer, or a copolymer having a non-color-developing polymer unit, which is bonded at $R_1$, X, $R_2$ or $R_3$ via a di- or more valent group.

Examples of the coupler represented by Formula (Y) are shown below:

(Y-1)
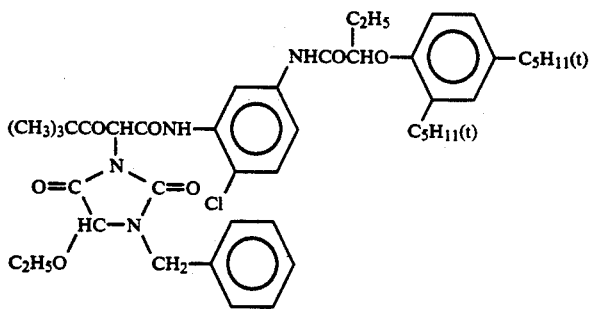
(Y-2)
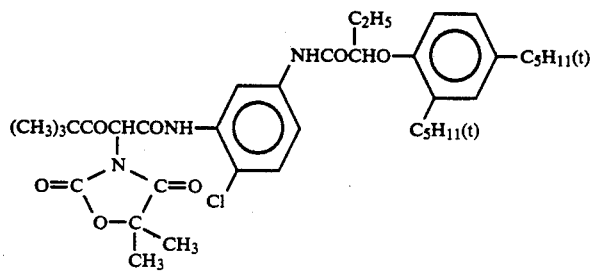
(Y-3)
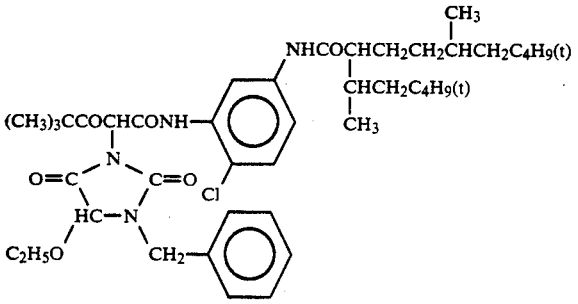
(Y-4)
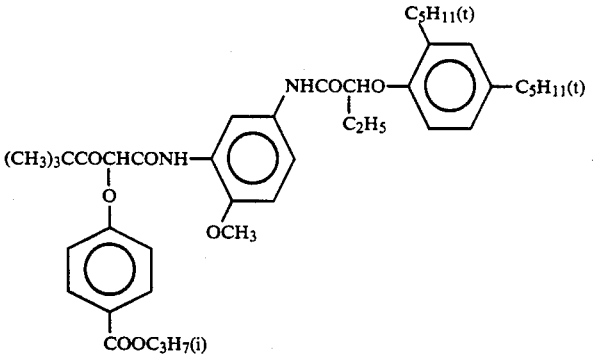
(Y-5)
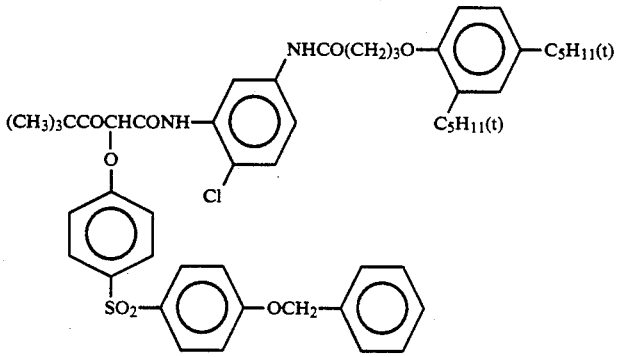

-continued
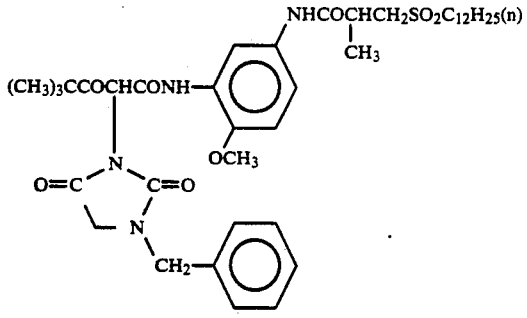
(Y-6)
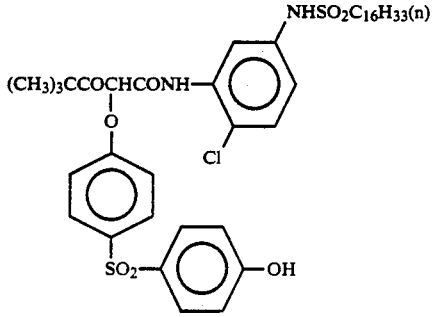
(Y-7)
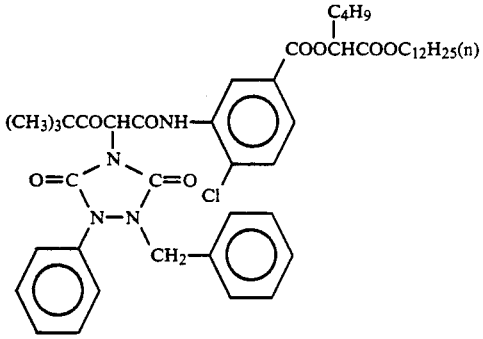
(Y-8)
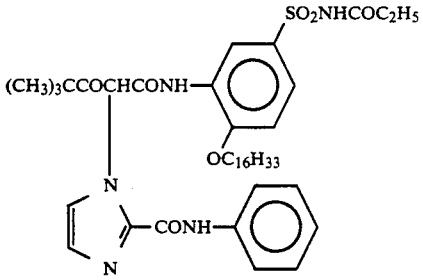
(Y-9)
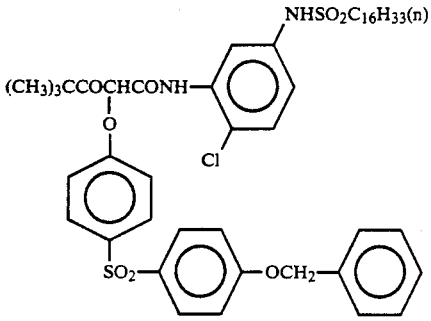
(Y-10)

-continued
(Y-11)
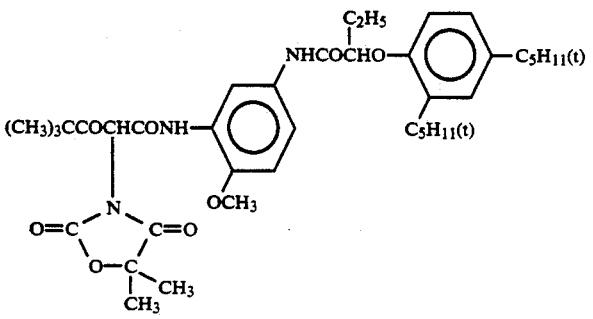
(Y-12)
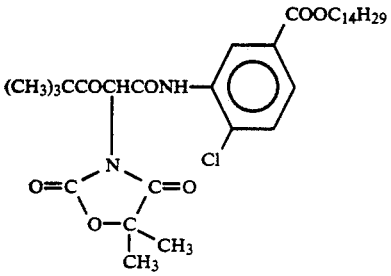
(Y-13)
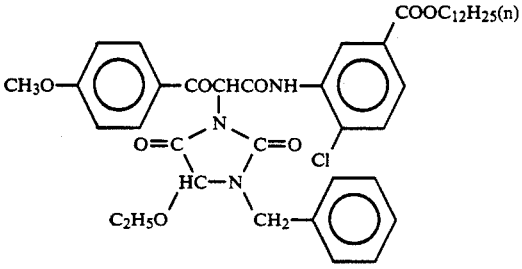
(Y-14)
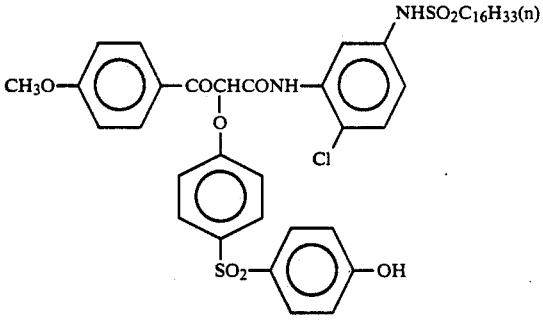
(Y-15)
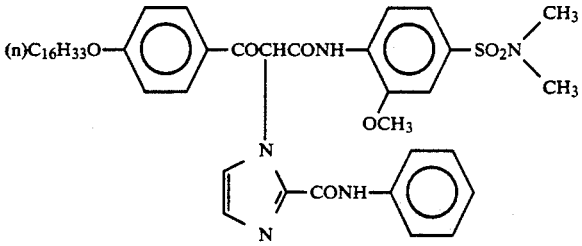

-continued
(Y-16)
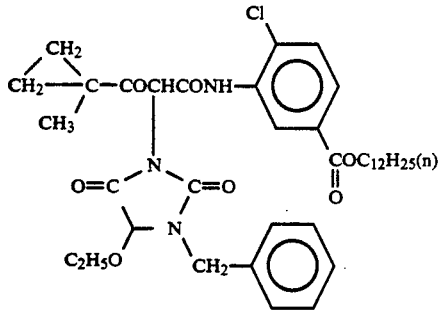
(Y-17)
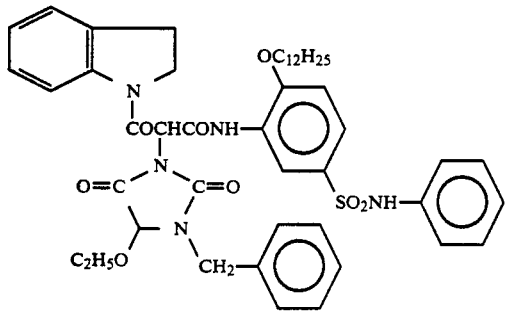
(Y-18)
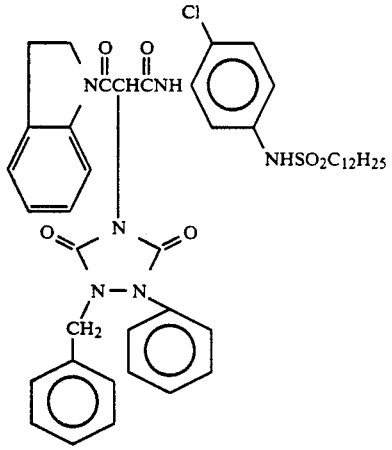
(Y-19)
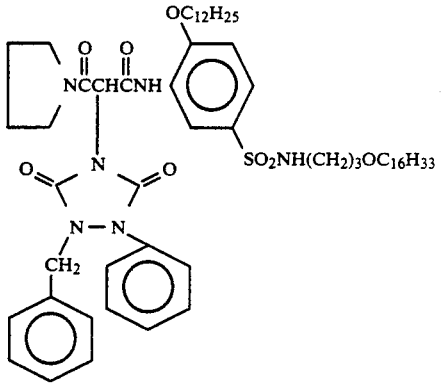

-continued
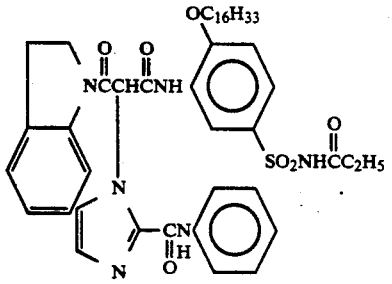
(Y-20)
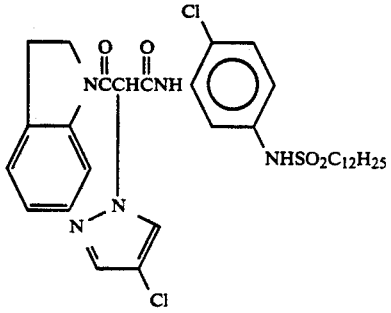
(Y-21)
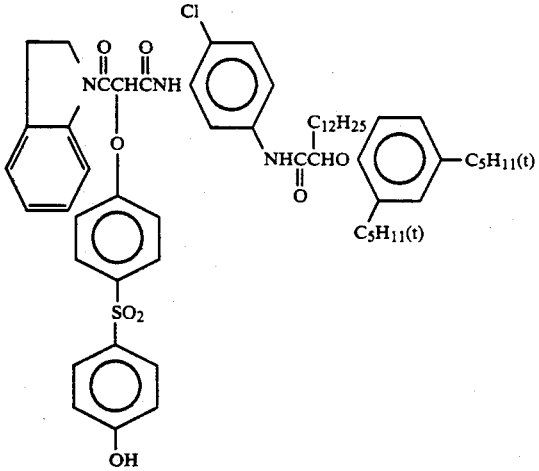
(Y-22)
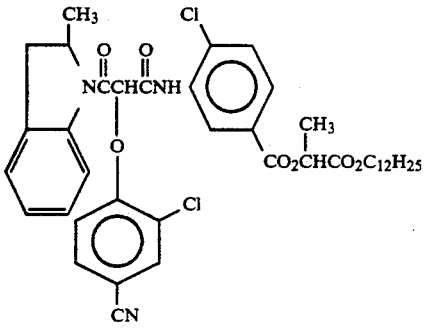
(Y-23)

-continued
(Y-24)
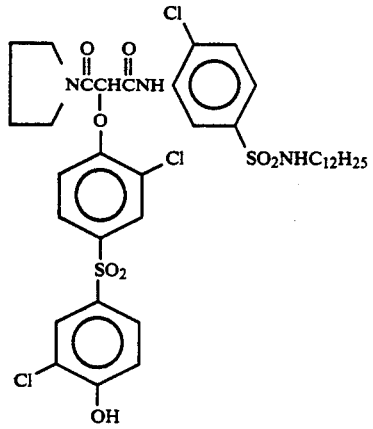
(Y-25)
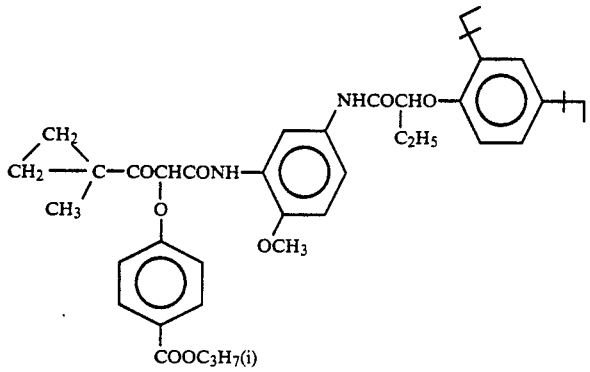
(Y-26)
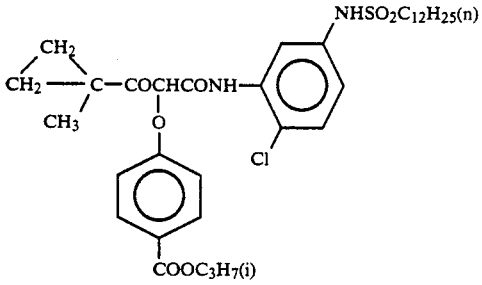
(Y-27)
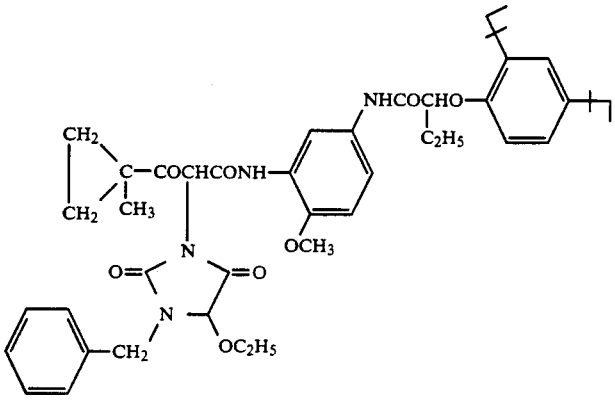

-continued (Y-28)

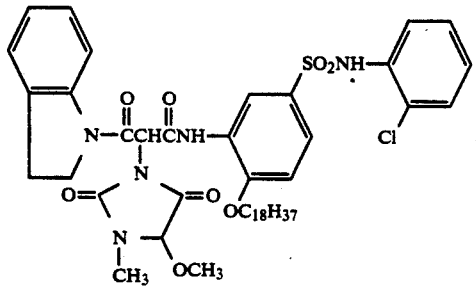

(Y-29)

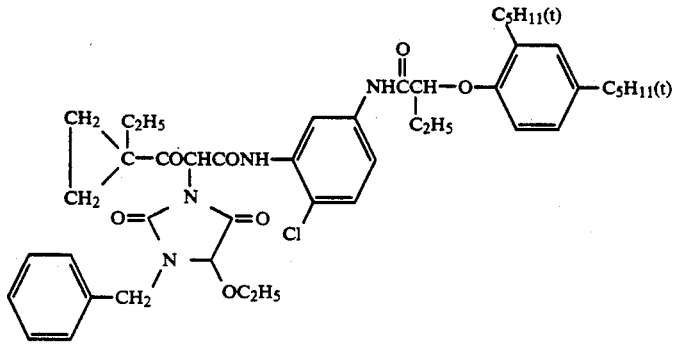

(Y-30)

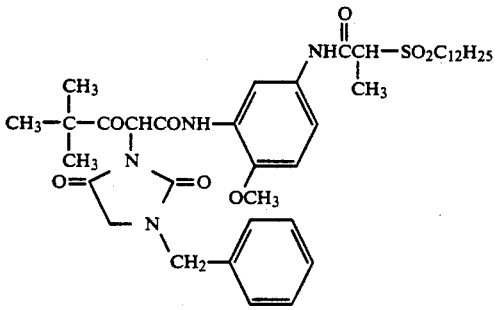

The synthesis methods of the yellow couplers in addition to the above compounds and/or other couplers used in the present invention are described in U.S. Pat. Nos. 3,227,554, 3,408,194, 3,894,875, 3,933,501, 3,973,968, 4,022,620, 4,057,432, 4,115,121, 4,203,768, 4,248,961, 4,266,019, 4,314,023, 4,327,175, 4,401,752, 4,404,274, 4,420,556, 4,711,837, and 4,729,944, European Patents 30,747A, 296,793A, and 313,308A, German Patent 3,107,173C, JP-A-59-174839, and JP-A-63-123047. The synthesis methods of dimer form couplers are described, for example, in U.S. Pat. No. 4,248,961 and those of polymer form couplers are described, for example, in European Patent 284,081A, JP-A-58-42044, and JP-A-62-276547.

The amount of the yellow coupler used in the present invention is suitably 0.001 to 1 mole, preferably 0.01 to 0.5 mole, per mole of light-sensitive silver halide.

The compound represented by Formula (I) and/or a color coupler can be introduced into a light-sensitive material by various known dispersing methods. They can be added by an oil-in-water dispersing method usually known as an oil protect method, wherein they are dissolved in a solvent and then are emulsified and dispersed in an aqueous gelatin solution containing a surface active agent. Or, water or an aqueous gelatin solution is added to the solution of the compound represented by Formula (I) and/or the color coupler containing a surface active agent to convert the mixed solution to an oil-in-water dispersion by a phase inversion. Also, the alkali-soluble compound represented by Formula (I) and/or a color coupler can be dispersed by a so-called Fisher dispersing method. After a low boiling solvent is removed from the dispersion of the compound represented by Formula (I) and/or the color coupler by the methods such as distillation, noodle washing and ultrafiltration, they may be mixed with a photographic emulsion. Preferably used as a dispersion medium for the compound represented by Formula (I) and a color coupler are a high boiling solvent and/or a water soluble high molecular compound each having a dielectric constant of 2 to 20 (25° C.) and a refractive index of 1.5 to 1.7. The compound represented by Formula (I) is preferably used when emulsified together with a color coupler.

Examples of the high boiling solvent used in the oil-in-water dispersing method are described in U.S. Pat. No. 2,322,027. The step and effect of a latex dispersing method which is one of the polymer dispersing methods, and examples of a latex for impregnation are described in U.S. Pat. No. 4,199363 and German Patent Applications (OLS) 2,541,274 and 2,541,230. Further, a dispersing method by an organic solvent soluble polymer is described in PCT International Patent Publication WO88/00723.

The high boiling organic solvents which can be used in the above oil-in-water dispersing method include phthalic acid esters, for example, dibutyl phthalate, dioctyl phthalate, dicyclohexyl phthalate, di-2-ethylhexyl phthalate, decyl phthalate, bis(2,4-di-t-amylphenyl) isophthalate, and bis(1,1-di-ethylpropyl) phthalate), phosphoric acid or phosphonic acid esters (for example, diphenyl phosphate, triphenyl phosphate, tricresyl phosphate, 2-ethylhexyldiphenyl phosphate, dioctylbutyl phosphate, tricyclohexyl phosphate, tri-2-ethylhexyl phosphate), triododecyl phosphate, and di-2-ethylhexylphenyl phosphate), benzoic acid esters (for example, 2-ethylhexyl benzoate, 2,4-dichlorobenzoate, dodecyl benzoate, and 2-ethylhexyl p-hydroxybenzoate), amides (for example, N,N-diethyl dodecanamide and N,N-diethyl laurylamide), alcohols or phenols (for example, isostearyl alcohol and 2,4-di-tert-amylphenol), aliphatic esters (for example, dibutoxyethyl succinate, di-2-ethylhexyl succinate, 2-hexyldecyl tetradecanate, tributyl citrate, diethyl azelate, isostearyl lactate, and trioctyl citrate), aniline derivatives (for example, N,N-dibutyl-2-butoxy-5-tert-octylaniline), chlorinated paraffin (for example, paraffins having a chlorine content of 10 to 80%), trimesic acid esters (for example, tributyl trimesate), dodecylbenzene, and diisopropylnaphthalene. Further, there may be used in combination as an auxiliary solvent, an organic solvent having a boiling point of 30° C. or higher and about 160° C. or lower (for example, ethyl acetate, butyl acetate, ethyl propionate, methyl ethyl ketone, cyclohexanone, 2-ethoxyethyl acetate, and dimethylformamide).

The color light-sensitive material of the present invention may contain a hydroquinone derivative, an aminophenol derivative and an ascorbic acid derivative as an anti-foggant.

Various anti-fading agents can be used in combination for the light-sensitive material of the present invention. Representative examples of an organic anti-fading agent for cyan, magenta and/or yellow images include hydroquinones, 6-hydroxychromans, 5-hydroxycoumarans, spirochromans, p-alkoxyphenols, hindered phenols represented by bisphenols, gallic acid derivatives, methylenedioxybenzenes, aminophenols, hindered amines, and ether or ester derivatives thereof in which the phenolic hydroxy groups thereof are silylated or alkylated. Further, the metal complex compounds represented by (bis-salicylaldoximate) nickel complex and (bis-N,N-dialkyldithiocarbamate) nickel complex can also be used.

Examples of the organic anti-fading agent include hydroquinones described in U.S. Pat. Nos. 2,360,290, 2,418,613, 2,700,453, 2,701,197, 2,728,659, 2,732,300, 2,735,765, 3,982,944, and 4,430,425, British Patent 1,363,921, U.S. Pat. Nos. 2,710,801 and 2,816,028; 6-hydroxychromans, 5-hydroxychromans and spirochromans described in U.S. Pat. Nos. 3,432,300, 3,573,050, 3,574,627, 3,698,909, and 3,764,337, and JP-A-52-152225; spiroindanes described in U.S. Pat. No. 4,360,589; p-alkoxyphenols described in U.S. Pat. No. 2,735,765, British Patent 2,066,975, JP-A-59-10539, and JP-B-57-19765; hindered phenols described in U.S. Pat. Nos. 3,700,455 and 4,228,235, JP-A-52-72224, and JP-B-52-6623; gallic acid derivatives described in U.S. Pat. No. 3,457,079; methylenedioxybenzenes described in U.S. Pat. No. 4,332,886; aminophenols described in JP-B-56-21144; hindered amines described in U.S. Pat. Nos. 3,336,135 and 4,268,593, British Patents 1,326,889, 1,354,313, and 1,410,846, JP-B-51-1420, JP-A-58-114036, JP-A-59-53846, and JP-A-59-73844; and metal complex compounds described in U.S. Pat. Nos. 4,050,938 and 4,241,155, and British Patent 2,027,731 (A). These compounds, which are emulsified together with the respective corresponding couplers in the ratios of 5 to 100% by weight based on the amounts of the couplers, are added to a light-sensitive layer to achieve the objects of the present invention.

The known anti-fading agents described above can be used in such an amount that the compound represented by Formula (I) can attain the effects of the present invention.

The introduction of a UV absorber into a cyan dye layer and the two layers surrounding the cyan dye layer is more effective for preventing the fading of a cyan dye by heat and especially by light.

The UV absorber may be benzotriazole compounds substituted with an aryl group (for example, the compounds described in U.S. Pat. No. 3,533,794), 4-thiazolidone compounds (for example, the compounds described in U.S. Pat. Nos. 3,314,794 and 3,352,681), benzophenone compounds (for example, the compounds described in JP-A-46-2784), cinnamic acid ester compounds (for example, the compounds described in U.S. Pat. Nos. 3,705,805 and 3,707,395), butadiene compounds (for example, the compounds described in U.S. Pat. No. 4,045,229), and benzoxazole compounds (for example, the compounds described in U.S. Pat. Nos. 3,406,070 and 4,271,307). There may be used a UV absorptive coupler (for example, α-naphthol type cyan dye-forming coupler) and a UV absorptive polymer. These UV absorbers may be mordanted in a specific layer. Of the above compounds, the benzotriazole compounds substituted with an aryl group are preferred.

In applying the present invention to a multilayered silver halide color photographic light-sensitive material, there can be provided on a support each at least one layer of a blue-sensitive silver halide emulsion layer containing a yellow coupler, a green-sensitive silver halide emulsion layer containing a magenta coupler, and a red-sensitive silver halide emulsion layer containing a cyan coupler in this order to constitute the photographic light-sensitive material. The order of the layers may be different from that above. Further, at least one of the above light-sensitive layers can be replaced by an infrared-sensitive silver halide emulsion layer. Silver halide emulsions having sensitivities in the respective wavelength regions and the color couplers forming the dyes having the complementary color relations with the wavelength regions in which the respective light-sensitive layers are sensitive can be incorporated into these light-sensitive layers to reproduce the original colors by a subtractive color process. In addition, the combination of color couplers with blue-sensitive, green-sensitive and red-sensitive emulsion layers stated above can be changed to each other, if necessary.

A color light-sensitive material in which a developing agent is not contained previously, that is a color light-sensitive material which is processed with a color developing solution containing an aromatic primary amine type color developing agent and then subjected to desilvering processing to form a color image, for example, a color paper, a color reversal paper, a direct positive color light-sensitive material, a color negative film, a color positive film, and a color reversal film can be used in the present invention. Of them, preferred are color light-sensitive materials having a reflecting support (for example, a color paper and a color reversal paper) and color light-sensitive materials forming a positive image (for example, a direct positive color light-sensitive material, a color positive film and a color reversal film).

Preferably used in the present invention are the silver halide emulsions, the other materials (additives and the like), the photographic structural layers (a layer arrangement and the like), and the processing methods and processing additives for processing the light-sensitive material, each described in the following patent publications. Particularly, the constituent elements described in European Patent 0,355,660A2 are preferably used.

TABLES 1 to 5

| Photographic constituent elements | JP-A-62-215272 | JP-A-2-33144 | EP 0355660 |
|---|---|---|---|
| Silver halide emulsion | p. 10, right upper column, line 6 to p. 12, left lower column, line 5, and p. 12, right lower column, line 4 from bottom to p. 13, left upper column, line 17. | p. 28, right upper column, line 16 to p. 29, right lower column, line 11, and p. 30, lines 2 to 5. | p. 45, line 53 to p. 47, line 3 and p. 47, lines 20 to 22. |
| Silver halide solvent | p. 12, left lower column, lines 6 to 14, and p. 13, left upper column, line 3 from bottom to p. 18, left lower column, last line. | — | — |
| Chemical sensitizer | p. 12, left lower column, line 3 from bottom to right lower column, line. 5 from bottom, and p. 18, right lower column, line 1 to p. 22, right upper column, line 9 from bottom. | p. 29, right lower column, line 12 to last line. | p. 47, lines 4 to 9. |
| Spectral sensitizer (spectral sensitizing method) | p. 22, right upper column, line 8 from bottom to p. 38, last line. | p. 30, left upper column, lines 1 to 13. | p. 47, lines 10 to 15 |
| Emulsion stabilizer | p. 39, left upper column, line 1 to p. 72, right upper column, last line. | p. 30, left upper column, line 14 to right upper column, line 1. | p. 47, lines 16 to 19. |
| Development accelerator | p. 72, left lower column, line 1 to p. 91, right upper column, line 3. | — | — |
| Color coupler (cyan, magenta and yellow couplers) | p. 91, right upper column, line 4 to p. 121, left upper column, line 6 | p. 3, right upper column, line 14 to p. 18, left upper column, last line, and p. 30, right upper column, line 6 to p. 35 right lower column, line 11. | p. 4, lines 15 to 27, p. 5, line 30 to p. 28, last line, and p. 47, line 23 to p. 63, line 50. |
| Color forming accelerator | p. 121, left upper column, line 7 to p. 125, right upper column, line 1. | — | — |
| UV absorber | p. 125, right upper column, line 2 to p. 127, left lower column, last line. | p. 37, right lower column, line 14 to p. 38, left upper column, line 11. | p. 65, lines 22 to 31. |
| Anti-fading agent (an image stabilizer) | p. 127, right lower column, line 1 to p. 137, left lower column, line 8. | p. 36, right upper column, line 12 to p. 37, left upper column, line 19. | p. 4, line 30 to p. 5, line 23, p. 29, line 1 to p. 45, line 25, p. 45, lines 33 to 40, and p. 65, lines 2 to 21. |
| High boiling and/or low boiling organic solvent | p. 137, left lower column, line 9 to p. 144, right upper, last line. | p. 35, right lower column, line 14 to p. 36, left upper, line 4. | p. 64, lines 1 to 51. |
| Method for dispersing photographic additives | p. 114, left lower column, line 1 to p. 146, right upper column, line 7. | p. 27, right lower column, line 10 to p. 28, left upper, last line, and p. 35, right lower column, line 12 to p. 36, right upper column, line 7. | p. 63, line 51 to p. 64, line 56. |
| Hardener | p. 146, right upper column, line 8 to p. 155, left lower column, line 4. | — | — |
| Precursor of a developing agent | p. 155, left lower column, line 5 to right lower column, line 2. | — | — |
| Development inhibitor-releasing compound | p. 155, right lower column, lines 3 to 9. | — | — |
| Support | p. 155, right lower column, line 19 to p. 156, left upper column, line 14. | p. 38, right upper column, line 18 to p. 39, left upper column, line 3. | p. 66, line 29 to p. 67 line 13. |
| Light-sensitive | p. 156, left upper column, | p. 28, right upper column, | p. 45, lines 41 to 52. |

TABLES 1 to 5-continued

| Photographic constituent elements | JP-A-62-215272 | JP-A-2-33144 | EP 0355660 |
|---|---|---|---|
| layer structure | line 15 to right lower column, line 14. | lines 1 to 15. | |
| Dye | p. 156, right lower column, line 15 to p. 184, right lower column, last line. | p. 38, left upper column, line 12 to right upper column, line 7. | p. 66, lines 18 to 22. |
| Anti-color mixing agent | p. 185, left upper column, line 1 to p. 188, right lower column, line 3. | p. 36, right upper column, lines 8 to 11. | p. 64, line 57 to p. 65 line 1. |
| Gradation controller | p. 188, right lower column, lines 4 to 8 | — | — |
| Anti-stain agent | p. 188, right lower column, line 9 to p. 193, right lower column, line 10. | p. 37, left upper column, last line to right lower column, line 13. | p. 65, line 32 to p. 66, line 17. |
| Surface active agent | p. 201, left lower column, line 1 to p. 210, right upper column, last line | p. 18, right upper column, line 1 to p. 24, right lower column, last line, and p. 27, left lower column, line 10 from bottom to right lower column, line 9. | — |
| Fluorinated compound (anti-static agent, coating aid, lubricant and anti-adhesion agent) | p. 210, left lower column, line 1 to p. 222, left lower column, line 5. | p. 25, left upper column, line 1 to p. 27, right lower column, line 9. | — |
| Binder (hydrophilic colloid) | p. 222, left lower column, line 6 to p. 225, left upper column, last line. | p. 38, right upper column, line 8 to 18. | p. 66, lines 23 to 28. |
| Thickener | p. 225, right upper column, line 1 to p. 227, right upper column, line 2. | — | — |
| Anti-static agent | p. 227, right upper column, line 3 to p. 230, left upper column, line 1. | — | — |
| Polymer latex | p. 230, left upper column, line 2 to p. 239, last line | — | — |
| Matting agent | p. 240, left upper column, line 1 to right upper column, last line. | — | — |
| Photographic processing method (processing steps and additives) | p. 3, right upper column, line 7 to p. 10, right upper column, line 5. | p. 39, left upper column, line 4 to p. 42, left upper column, last line. | p. 67, line 14 to p. 69, line 28. |

Remarks:
1. There is included in the cited items from JP-A-62-215272, the content amended according to the Amendment of March 16, 1988.
2. Of the above color couplers, also preferably used are the so-called short wave type yellow couplers described in JP-A-63-231451, JP-A-63-123047, JP-A-63-241547, JP-A-1-173499, JP-A-1-213648, and JP-A-1-250944.

Further, preferably used as a cyan coupler are 3-hydroxypyridine type cyan couplers described in European Patent 0,333,185A2 (of them, particularly preferred are the couplers converted to divalency by providing the tetravalent coupler of Coupler 42 exemplified as an example with a chlorine splitting off group, and Couplers 6 and 9), and the cyclic active methylene type cyan couplers described in JP A 64-32260 (of them, particularly preferred are Couplers 3, 8 and 34 exemplified as example).

In the present invention, silver halide may be, silver chloride, silver bromide, silver bromochloride, silver bromochloroiodide, and silver bromoiodide. Preferably used is silver bromochloride or silver chloride containing substantially no silver iodide and having a silver chloride content of 90 mole % or more, preferably 95 mole % or more and more preferably 98 mole % or more particularly for the purpose of rapid processing.

Further, in the light-sensitive material according to the present invention, preferably incorporated into a hydrophilic colloid layer for the purpose of improving sharpness of an image are the dyes (especially, oxonol dyes) described on pages 27 to 76 of European Patent 0,337,490A2, which can be bleached by processing so that the optical reflection density of a light-sensitive material in 680 nm becomes 0.70 or more. It is also preferred that titanium dioxide of 12% by weight or more (preferably 14% by weight or more) subjected to a surface treatment with di- to tetrahydric alcohol (for example, trimethylol ethane) is incorporated into a waterproof resin layer of a support.

Also in the light-sensitive material according to the present invention, the color image preservability-improving compounds described in European Patent 0,277,589A2 are preferably used together with couplers. In particular, they are used preferably in combination with a pyrazoloazole coupler.

Preferably used for removing side effects of, for example, the generation of stain due to the reaction of a color developing agent or an oxidation product thereof remaining in a layer with a coupler during storage after processing are the compounds (A) disclosed in European Patent 277,589A2 which are chemically combined with an aromatic amine type developing agent remaining after color development processing to form a chemically inactive and substantially colorless compound, and/or the compounds (B) disclosed in European Patent 277,589A2 which are chemically combined with the oxidation product of an aromatic amine type developing agent remaining after color development processing to form a chemically inactive and substantially colorless compound.

Further, the anti-mold agents described in JP-A-63-271247 are preferably added to the light-sensitive material according to the present invention for the purpose of preventing various molds and bacteria which grow in a hydrophilic colloid layer to deteriorate an image.

The support for the light-sensitive material according to the present invention for display may be, a white color polyester type support or a support in which a layer containing a white pigment is provided on a support side having a silver halide emulsion layer. An antihalation layer is preferably provided on a support side on which a silver halide emulsion layer is coated or the backside thereof in order to improve sharpness further. In particular, the transmission density of a support is controlled in the range of 0.35 to 0.8 so that a display can be admired with either a reflected light or a transmitted light.

The light-sensitive material according to the present invention may be exposed with either a visible ray or an infrared ray. The exposure may be either a low illuminance exposure or a high illuminance exposure for a short time. Particularly in the latter case, preferred is a laser scanning exposing method in which the exposure time per a picture element is shorter than $10^{-4}$ second.

In exposure, a band stop filter described in U.S. Pat. No. 4,880,726 is preferably used, whereby a light mixture is removed to notably improve a color reproduction.

The light-sensitive material according to the present invention can be subjected to a development processing by the conventional method described on pages 28 to 29 of *Research Disclosure* No. 17643 and on a left column to a right column of 615 of *Research Disclosure* No. 18716. For example, a color development processing step, a desilver processing step, and a washing processing step are carried out. In the desilver processing step, a bleaching step using a bleaching agent and a fixing step using a fixing agent can be replaced with a bleach-fixing step using a bleach-fixing agent, and a bleaching step, a fixing step and a bleach-fixing step may be combined in an arbitrary order. A washing step may be replaced with a stabilizing step, and the washing step may be followed by the stabilizing step. Further, there can also be carried out a mono bath processing step in which color developing, bleaching and fixing are carried out in a single bath using a mono bath develop-bleach-fixing processing solution. In combination with these processing steps, there may be carried out a prehardening step, a nutralizing step therefor, a stopping step, a post-hardening step, an adjusting step, and an intensifying step. In these processings, the color development processing step may be replaced with a so-called activator processing step.

The present invention will be explained below with reference to the examples but not limited thereto.

EXAMPLE 1

A high boiling organic solvent dibutyl phthalate of 16.1 g was added to the Yellow Coupler (Y-1) of 16.1 g, and further, ethyl acetate of 24 ml was added to dissolve the yellow coupler. The solution thus prepared was emulsified for dispersing in a 10 weight % gelatin aqueous solution containing sodium dodecylbenzenesulfonate of 1.5 g.

The whole quantity of this emulsified dispersion was added to a high silver chloride emulsion (silver: 70.0 g/kg of emulsion, a silver bromide content: 0.5 mole %) to prepare a coating solution. This coating solution was applied on a cellulose triacetate film base provided with a subbing layer so that the coated amount of silver was 1.73 g/m$^2$. A protective layer of a gelatin layer was coated thereon so that the dry layer thickness was 1.0 μm, whereby Sample 101 was prepared. Sodium 1-oxy-3,5-dichloro-s-triazine was used as a hardener for the gelatin.

Sample Nos. 102 to 116 were prepared in the same manner as Sample No. 101, except that the combination of the yellow coupler and a color image stabilizer (added by 100 mole % to the coupler) was changed as shown in Table A.

The respective samples thus prepared were subjected to a wedge exposure and then to a development processing in the following processing steps:

| Processing Step | Temperature | Time |
|---|---|---|
| Color developing | 35° C. | 45 sec. |
| Bleach-fixing | 30 to 35 | 45 |
| Rinsing (1) | 30 to 35 | 20 |
| Rinsing (2) | 30 to 35 | 20 |
| Rinsing (3) | 30 to 35 | 20 |
| Drying | 70 to 80 | 60 |

The compositions of the respective processing solutions were as shown below:

| | |
|---|---|
| Color Developing Solution | |
| Water | 800 ml |
| Ethylenediamine-N,N,N',N'-tetramethylene phosphonic acid | 1.5 g |
| Potassium bromide | 0.015 g |
| Triethanolamine | 8.0 g |
| Sodium chloride | 1.4 g |
| Potassium carbonate | 25 g |
| N ethyl-N-(β-methanesulfonamidethyl)-3-methyl-4-aminoaniline sulfate | 5.0 g |
| N,N-bis(carboxymethyl) hydrazine | 5.5 g |
| Fluorescent whitening agent (Whitex 4B manufactured by Sumitomo Chemical Ind. Co., Ltd.) | 1.0 g |
| Water was added to | 1000 ml |
| pH (25° C.) was adjusted to | 10.05 |
| Bleach-Fixing Solution | |
| Water | 400 ml |
| Ammonium thiosulfate (700 g/liter) | 100 ml |
| Sodium sulfite | 17 g |
| Iron (III) ammonium ethylenediaminetetracetate | 55 g |
| Disodium ethylenediaminetetracetate | 5 g |
| Ammonium bromide | 40 g |
| Water was added to | 1000 ml |
| pH (25° C.) was adjusted to | 6.0 |

Rinsing Water

Ion-exchanged water (contents of calcium and magnesium: each 3 ppm or lower)

Respective Sample Nos. 101 to 116 on which the color images were thus formed were exposed for 8 days via a UV ray-absorbing filter cutting a ray of 400 nm or less, manufactured by Fuji Photo Film Co., Ltd., with a xenon tester (illuminance: 200,000 lux). A yellow density (stain) of an unexposed portion and a residual rate of density of an initial density of 2.0 in the respective samples were measured.

The measurements were carried out with a Fuji automatic densitometer. The results thus obtained are shown in Table A.

TABLE A

| Sample No. | Coupler | Image Stabilizer | Exposure test with a xenon tester: Stain on background | Exposure test with a xenon tester: Residual rate of density (%) |
|---|---|---|---|---|
| 101 (Comp.) | Y-1 | — | 0.15 | 50 |
| 102 (Inv.) | Y-1 | I-9 | 0.13 | 81 |
| 103 (Inv.) | Y-1 | I-20 | 0.13 | 83 |
| 104 (Inv.) | Y-1 | I-21 | 0.15 | 74 |
| 105 (Comp.) | Y-1 | (a)* | 0.27 | 52 |
| 106 (Comp.) | Y-1 | (b)* | 0.23 | 52 |
| 107 (Comp.) | Y-7 | — | 0.16 | 42 |
| 108 (Inv.) | Y-7 | I-2 | 0.13 | 78 |
| 109 (Inv.) | Y-7 | I-4 | 0.14 | 73 |
| 110 (Inv.) | Y-7 | I-6 | 0.14 | 76 |
| 111 (Inv.) | Y-7 | I-8 | 0.13 | 80 |
| 112 (Inv.) | Y-7 | I-12 | 0.13 | 82 |
| 113 (Com.) | Y-7 | (a)* | 0.27 | 45 |
| 114 (Comp.) | Y-7 | (b)* | 0.25 | 47 |
| 115 (Comp.) | Y-7 | (c)* | 0.28 | 48 |
| 116 (Comp.) | Y-7 | (d)* | 0.18 | 50 |

*Comparative compound

Comparative Compound (a)

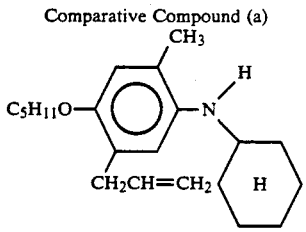

(the compound described in JP-A-55-6321)

Comparative Compound (b)

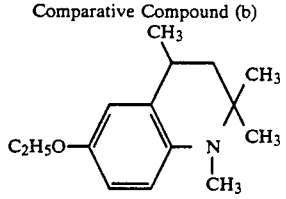

(the compound described in JP-A-63-23150)

Comparative Compound (c)

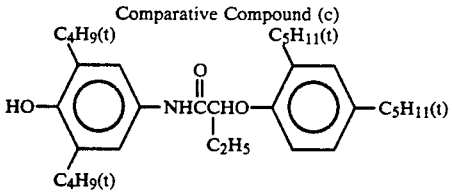

(the compound described in JP-A-52-150630)

Comparative Compound (d)

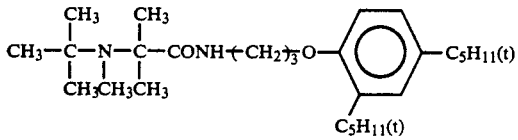

(the compound described in JP-A-1-223450)

It has been found from the above results that the compounds represented by Formula (I) are effective for preventing light fading of a color image and that they are effective as well for preventing yellowing of the unexposed portion. The compounds of the present invention have demonstrated such good light fading prevention which could not have expected from commonly known compounds.

EXAMPLE 2

Sample Nos. 101 to 116 prepared in Example 1 were left to stand at 100° C. for 7 days. Then, a yellow density (stain) of an unexposed portion and a residual rate of density of an initial density of 1.0 in the respective samples were measured. The measurements were carried out with a Fuji automatic densitometer. The results thus obtained are shown in Table B.

TABLE B

| Sample No. | Coupler | Image stabilizer | Exposure test with a xenon tester: Stain on background | Exposure test with a xenon tester: Residual rate of density (%) |
|---|---|---|---|---|
| 101 (Comp.) | Y-1 | — | 0.14 | 70 |
| 102 (Inv.) | Y-1 | I-9 | 0.12 | 85 |
| 103 (Inv.) | Y-1 | I-20 | 0.12 | 84 |
| 104 (Inv.) | Y-1 | I-21 | 0.14 | 78 |
| 105 (Comp.) | Y-1 | (a)* | 0.28 | 72 |
| 106 (Comp.) | Y-1 | (b)* | 0.22 | 74 |
| 107 (Comp.) | Y-7 | — | 0.15 | 54 |
| 108 (Inv.) | Y-7 | I-2 | 0.14 | 75 |
| 109 (Inv.) | Y-7 | I-4 | 0.15 | 71 |
| 110 (Inv.) | Y-7 | I-6 | 0.14 | 73 |
| 111 (Inv.) | Y-7 | I-8 | 0.13 | 79 |
| 112 (Inv.) | Y-7 | I-12 | 0.13 | 80 |
| 113 (Comp.) | Y-7 | (a)* | 0.28 | 59 |
| 114 (Comp.) | Y-7 | (b)* | 0.22 | 60 |
| 115 (Comp.) | Y-7 | (c)* | 0.22 | 55 |
| 116 (Comp.) | Y-7 | (d) | 0.17 | 58 |

*Comparative Compound

It has been found from the above results that the compounds of the present invention are effective for preventing thermal fading of a color image and that they are effective as well for preventing yellowing of the unexposed portion.

EXAMPLE 3

A gelatin subbing layer containing sodium dodecylbenzene-sulfonate was provided on a paper support laminated on the both sides thereof with polyethylene after the surface thereof was subjected to a corona discharge. Then, various photographic structural layers were coated thereon, whereby a multilayered color photographic paper having the following layer structure was prepared. The coating solutions were prepared in the following manners:

Preparation of the fifth layer-coating solution

Ethyl acetate 50 ml and a solvent (Solv-6) 14.0 g were added to a cyan coupler (ExC) 32.0 g, a color image stabilizer (Cpd-2) 3.0 g, a color image stabilizer (Cpd-4) 2.0 g, a color image stabilizer (Cpd-6) 18.0 g, a color image stabilizer (Cpd-7) 40.0 g, and a color image stabilizer (Cpd-8) 5.0 g for dissolving. This solution was added to a 20% gelatin solution 500 ml containing sodium dodecylbenzenesulfonate 8 ml. The solution was emulsified and dispersed with a supersonic homogenizer to prepare thereby an emulsified dispersion. Meanwhile, there was prepared a silver chlorobromide emulsion (cubic, the mixture of large size silver halide grains having an average grain size of 0.58 μm and small size silver halide grains having an average grain size of 0.45 μm in an Ag molar ratio of 1:4, in which the variation coefficients of the grain size distributions were 0.09 and 0.11, respectively and both grains contain 0.6 mole % of AgBr localized on a part of the grain surface). The following red-sensitive Sensitizing Dye E was added to the large size emulsion and small size emulsion in the amounts of $0.9\times10^{-4}$ mole and $1.1\times10^{-4}$ mole per mole of silver, respectively. A sulfur sensitizer and a gold sensitizer were added to this emulsion for chemical ripening. The above emulsified dispersion and this red-sensitive silver chlorobromide emulsion were mixed together to prepare the fifth layer-coating solution so that the layer composition was as shown below.

The coating solutions for providing the first to fourth layers, the sixth layer and the seventh layer also were prepared in the same manner as the fifth layer-coating solution. Sodium 1-oxy-3,5-dichloro-s-triazine was used as a hardener for the respective layers.

Further, Cpd-10 and Cpd-11 were added to the respective layers so that the total amounts thereof were 25.0 mg/m$^2$ and 50.0 mg/m$^2$, respectively.

The following spectral sensitizing dyes were incorporated into the silver chlorobromide emulsions contained in the respective light-sensitive layers.

Blue-sensitive emulsion layer

Sensitizing Dye A

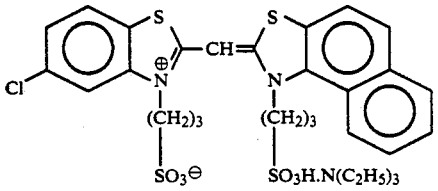

Sensitizing Dye B

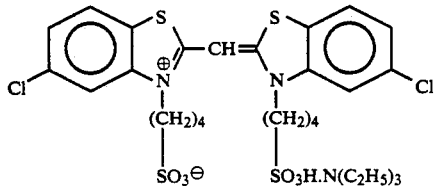

The above sensitizing dyes were added to the large size emulsion each in an amount of $2.0\times10^{-4}$ mole per mole of silver halide and to the small size emulsion each in an amount of $2.5\times10^{-4}$ mole per mole of silver halide.

Green-sensitive emulsion layer

Sensitizing Dye C

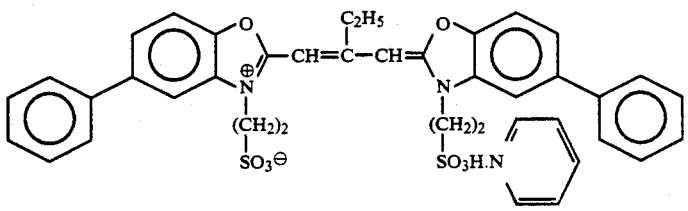

The above sensitizing dye was added to the large size emulsion in an amount of $4.0\times10^{-4}$ mole per mole of silver halide and to the small size emulsion in an amount of $5.6\times10^{-4}$ mole per mole of silver halide.

Sensitizing Dye D

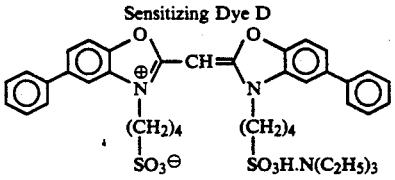

The above sensitizing dye was added to the large size emulsion in an amount of $7.0\times10^{-5}$ mole per mole of silver halide and to the small size emulsion in an amount of $1.0\times10^{-5}$ mole per mole of silver halide.

Red-sensitive emulsion layer

Sensitizing Dye E

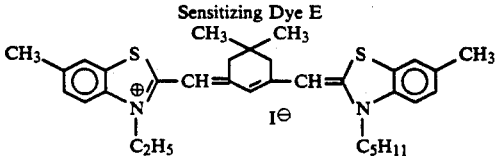

The above sensitizing dye was added to the large size emulsion in an amount of $0.9\times10^{-4}$ mole per mole of silver halide and to the small size emulsion in an amount of $1.1\times10^{-4}$ mole per mole of silver halide.

Further, the following compound was added in an amount of $2.6\times10^{-3}$ mole per mole of silver halide.

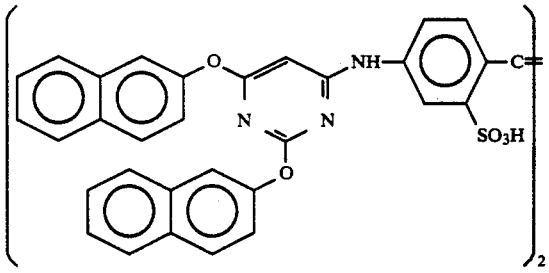

1-(5-Methylureidophenyl)-5-mercaptotetrazole was added to the blue-sensitive emulsion layer, green-sensitive emulsion layer and red-sensitive emulsion layer in amounts of $8.5\times10^{-5}$, $7.7\times10^{-4}$ and $2.5\times10^{-4}$ mole each per mole of silver halide, respectively.

Further, 4-hydroxy-6-methyl-1,3,3a, 7-tetrazaindene was added to the blue-sensitive emulsion layer and green-sensitive emulsion layer in the amounts of $1\times10^{-4}$ and $2\times10^{-4}$ mole each per mole of silver halide, respectively.

Also, the following dyes were added to the emulsion layers for preventing irradiation (the number in a parenthesis represents a coated amount).

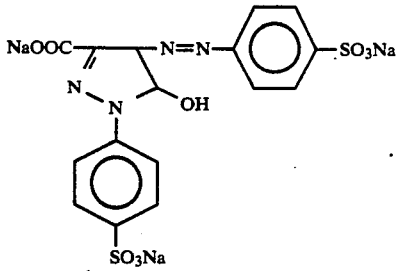

(10 mg/m²)

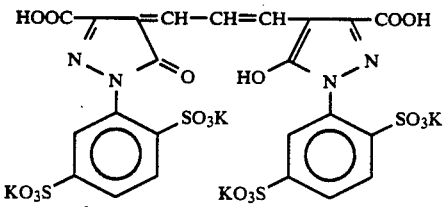

(10 mg/m²)

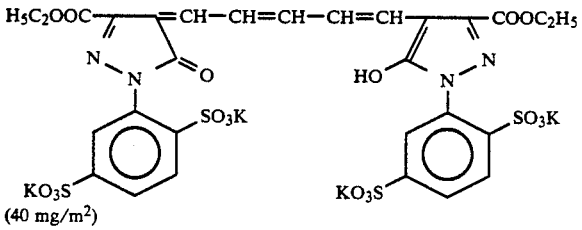

(40 mg/m²)

and

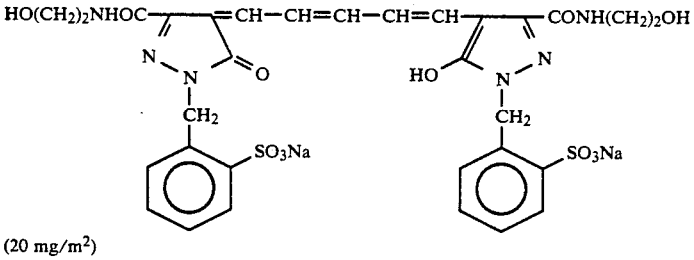

(20 mg/m²)

Layer structure

The compositions of the respective layers are shown below. The numbers represent the coated amounts (g/m²). The coated amounts of the silver halide emulsions are in terms of the amounts converted to silver.

Support

Polyethylene-laminated paper (a white pigment ($TiO_2$) and a blue dye(ultramarine) were incorporated into polyethylene coated on an emulsion layer side of the paper).

| | |
|---|---|
| First layer (blue-sensitive emulsion layer) | |
| Silver chlorobromide emulsion (cube, the mixture of the large size silver halide grains having an average grain size of 0.88 μm and the small size silver halide grains having an average grain size of 0.70 μm in an Ag molar ratio of 3:7, in which the variation coefficients of the grain size distributions are 0.08 and 0.10, respectively and both grains contain 0.3 mole % of AgBr localized on a part of the grain surface) | 0.30 |
| Gelatin | 1.86 |
| Yellow coupler (ExY) | 0.82 |
| Color image stabilizer (Cpd-1) | 0.19 |
| Solvent (Solv-3) | 0.18 |
| Solvent (Solv-7) | 0.18 |
| Color image stabilizer (Cpd-7) | 0.06 |
| Second layer (color mixing prevention layer) | |
| Gelatin | 0.99 |
| Color mixing prevention agent (Cpd-5) | 0.08 |
| Solvent (Solv-1) | 0.16 |
| Solvent (Solv-4) | 0.08 |
| Third layer (green-sensitive layer) | |
| Silver chlorobromide emulsion (cube, the mixture of the large size silver halide grains having an average grain size of 0.55 μm and the small size silver halide grains having an average grain size of 0.39 μm in an Ag molar ratio of 1:3, in which | 0.12 |

-continued

| | |
|---|---|
| the variation coefficients of the grain size distributions are 0.10 and 0.08, respectively and both grains contain 0.8 mole % of AgBr localized on a part of the grain surface) | |
| Gelatin | 1.24 |
| Magenta coupler (ExM) | 0.23 |
| Color image stabilizer (Cpd-2) | 0.03 |
| Color image stabilizer (Cpd-3) | 0.16 |
| Color image stabilizer (Cpd-4) | 0.02 |
| Color image stabilizer (Cpd-9) | 0.02 |
| Solvent (Solv-2) | 0.40 |
| Fourth layer (UV absorbing layer) | |
| Gelatin | 1.58 |
| UV absorber (UV-1) | 0.47 |
| Color mixing prevention agent (Cpd-5) | 0.05 |
| Solvent (Solv-5) | 0.24 |
| Fifth layer (red-sensitive layer) | |
| Silver chlorobromide emulsion (cube, the mixture of the large size silver halide grains having an average grain size of 0.58 μm and the small size silver halide grains having an average grain size of 0.45 μm in an Ag molar ratio of 1:4, in which the variation coefficients of the grain size distributions are 0.09 and 0.11, respectively and both grains contain 0.6 mole % of AgBr localized on a part of the grain surface). | 0.23 |
| Gelatin | 1.34 |
| Cyan coupler (ExC) | 0.32 |
| Color image stabilizer (Cpd-2) | 0.03 |
| Color image stabilizer (Cpd-4) | 0.02 |
| Color image stabilizer (Cpd-6) | 0.18 |
| Color image stabilizer (Cpd-7) | 0.40 |
| Color image stabilizer (Cpd-8) | 0.05 |
| Solvent (Solv-6) | 0.14 |
| Sixth layer (UV absorbing layer) | |
| Gelatin | 0.53 |
| UV absorber (UV-1) | 0.16 |
| Color mixing prevention agent (Cpd-5) | 0.02 |
| Solvent (Solv-5) | 0.18 |
| Seventh layer (protective layer) | |
| Gelatin | 1.33 |
| Acryl-modified copolymer of vinyl alcohol (modification degree: 17%) | 0.17 |
| Liquid paraffin | 0.03 |

Yellow Coupler (ExY)

1/1 (by mol) mixture of the following compounds:

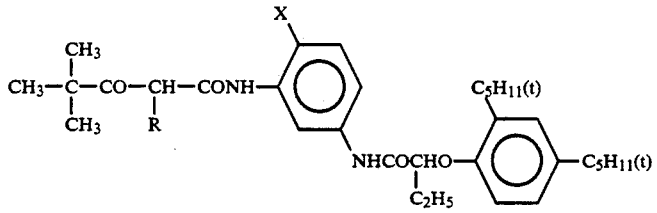

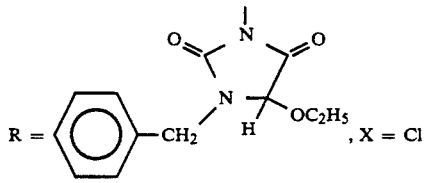

and

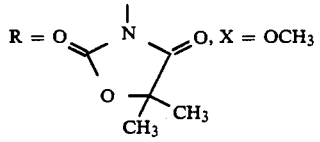

Magenta Coupler (ExM)

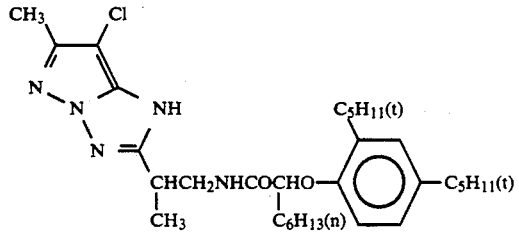

Cyan Coupler (ExC)

1/1 (by mol) mixture of the following compounds:

-continued
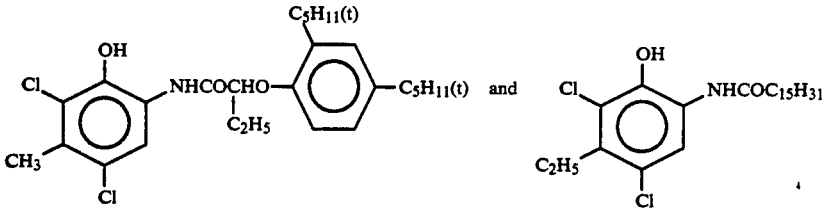
Color Image Stabilizer (Cpd-1)
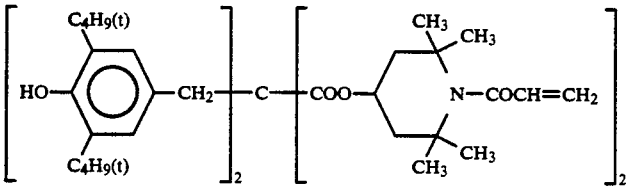
Color Image Stabilizer (Cpd-2)
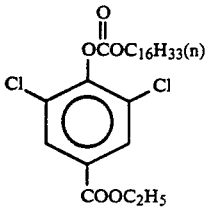
Color Image Stabilizer (Cpd-3)
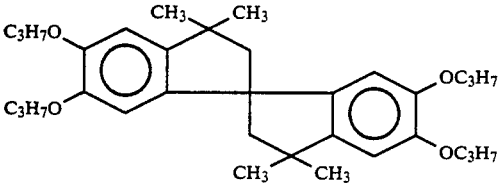
Color Image Stabilizer (Cpd-4)
mixture in a mole ratio of 1:1
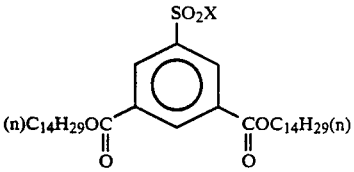
X = H and Na
Color Image Stabilizer (Cpd-5)
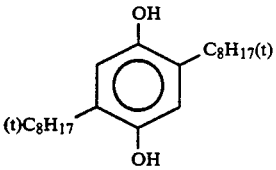
Color Image Stabilizer (Cpd-6)
mixture in a weight ratio of 2:4:4
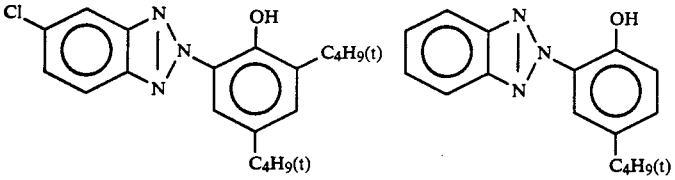

-continued
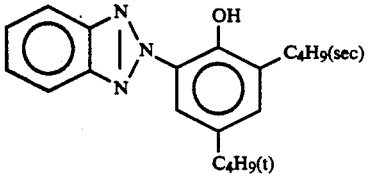
Color Image Stabilizer (Cpd-7)
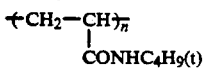
(average molecular weight 60,000)
Color Image Stabilizer (Cpd-8)
mixture in a weight ratio of 1:1
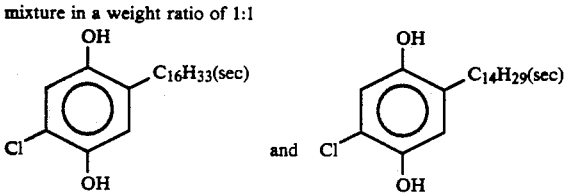
Color Image Stabilizer (Cpd-9)
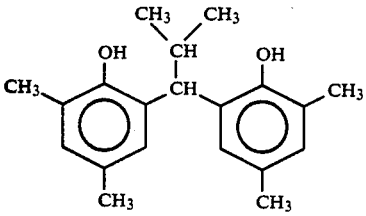
Preservative (Cpd-10)
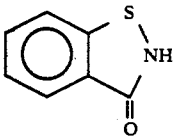
Preservative (Cpd-11)
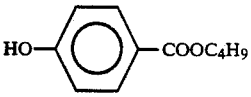
UV Absorber (UV-1)
mixture in a weight ratio of 4:2:4
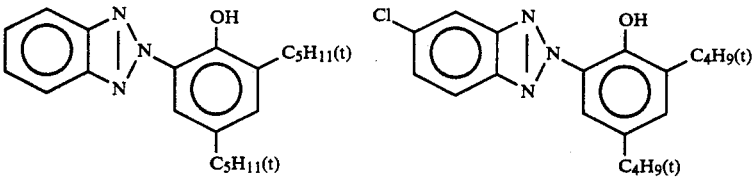
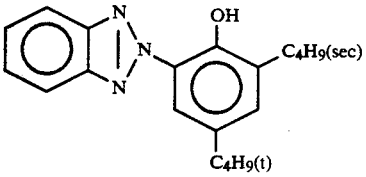
Solvent (Solv-1)

-continued

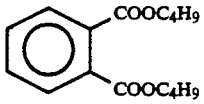

Solvent (Solv-2)
mixture in a volume ratio of 1:1

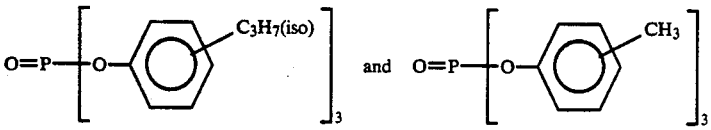

Solvent (Solv-3)
$O{=}P\text{+}O{-}C_9H_{19}(iso)]_3$

Solvent (Solv-4)

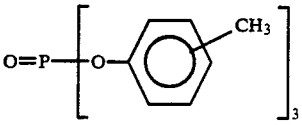

Solvent (Solv-5)
$COOC_8H_{17}$
|
$(CH_2)_8$
|
$COOC_8H_{17}$

Solvent (Solv-6)
mixture in a volume ratio of 80:20

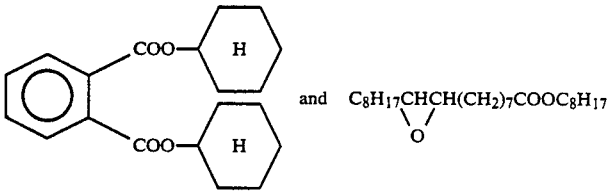

Solvent (Solv-7)
$C_8H_{17}CHCH(CH_2)_7COOC_8H_{17}$
O

Thus, Sample No. 1A was prepared. Sample Nos. 2A to 10A were prepared in the same manner as Sample No. 1A, except that the yellow coupler contained in the first layer and a color image stabilizer (further added to the color image stabilizers Cpd-1 and Cpd-7) were combined as shown in Table C. Comparative Compounds (a) and (b) are the same as those used in Example 1. These samples were processed as follows.

The respective samples were subjected to a gradation exposure via a three colors separation filter for sensitometry with a photographic densitometer (FWH type, a color temperature of a light source: 3200° K., manufactured by Fuji Photo Film Co., Ltd.), wherein the exposure was 250 CMS at an exposure time of 0.1 second.

The exposed samples were subjected to a continuous processing (a running test) with a paper processing machine in the processing solutions having the following compositions at the following processing steps until a replenished quantity of a color developing solution reached two times the tank capacity thereof.

| Processing step | Temperature | Time | Replenishing amount* | Tank capacity |
|---|---|---|---|---|
| Color developing | 35° C. | 45 sec | 161 ml | 17 liter |
| Bleach-fixing | 30 to 35° C. | 45 sec | 215 ml | 17 liter |
| Rinsing (1) | 30 to 35° C. | 20 sec | — | 10 liter |
| Rinsing (2) | 30 to 35° C. | 20 sec | — | 10 liter |
| Rinsing (3) | 30 to 35° C. | 20 sec | 350 ml | 10 liter |
| Drying | 70 to 80° C. | 60 sec | | |

*The replenishing amount is in terms of per $m^2$ of the light-sensitive material.

Rinsing was carried out in a countercurrent system from (3) to (2) and from (2) and to (1).

The compositions of the respective processing solutions are as follows:

Color Developing Solution

| | Tank Solution | Replenishing solution |
|---|---|---|
| Water | 800 ml | 800 ml |
| Ethylenediamine-N,N,N',N'-tetramethylene phosphonic acid | 1.5 g | 2.0 g |

-continued

| | Tank Solution | Replenishing solution |
|---|---|---|
| Potassium bromide | 0.015 g | — |
| Triethanolamine | 8.0 g | 12.0 g |
| Sodium chloride | 1.4 g | — |
| Potassium carbonate | 25 g | 25 g |
| N-ethyl-N-(β-methanesulfonamidoethyl)-3-methyl-4-aminoaniline sulfate | 5.0 g | 7.0 g |
| N,N-bis(carboxymethyl) hydrazine | 4.0 g | 5.0 g |
| Sodium N,N-di(sulfoethyl) hydroxylamine | 4.0 g | 5.0 g |
| Fluorescent whitening agent (Whitex 4B, manufactured by Sumitomo Chemical Ind. Co., Ltd.) | 1.0 g | 2.0 g |
| Water was added to | 1000 ml | 1000 ml |
| pH (25° C.) was adjusted to | 10.05 | 10.45 |

Bleach-fixing solution (a tank solution is the same as a replenishing solution)

| | |
|---|---|
| Water | 400 ml |
| Ammonium thiosulfate (70%) | 100 ml |
| Sodium sulfite | 17 g |
| Iron (III) ammonium ethylenediaminetetracetate | 55 g |
| Disodium ethylenediaminetetracetate | 5 g |
| Ammonium bromide | 40 g |
| Water was added to | 1000 ml |
| pH (25° C.) was adjusted to | 6.0 |

Rinsing solution (a tank solution is the same as a replenishing solution)

Ion-exchanged water (the contents of calcium and magnesium: each 3 ppm or lower)

The respective samples on which a color image was thus formed were subjected to a fading test. In order to evaluate an anti-fading effect, there were measured a residual rate of yellow density in an initial density of 2.0 after exposing with a xenon tester (illuminance: 200,000 lux) for 10 days and a residual rate of yellow density in an initial density of 1.0 after being left to stand at 100° C. for eight days. The results are shown in Table C.

TABLE C

| Sample No. | Yellow coupler | Image stabilizer | Exposure test*3 Stain*1 | Exposure test*3 Fading*2 | Standing test*4 Stain*1 | Standing test*4 Fading*5 |
|---|---|---|---|---|---|---|
| 1A (Comp.) | EXY | — | 0.18 | 52% | 0.18 | 65% |
| 2A (Inv.) | EXY | I-13 | 0.17 | 75% | 0.17 | 78% |
| 3A (Comp.) | EXY | (a)*6 | 0.28 | 59% | 0.30 | 67% |
| 4A (Comp.) | Y-10 | — | 0.20 | 48% | 0.19 | 50% |
| 5A (Inv.) | Y-10 | I-18 | 0.20 | 76% | 0.18 | 73% |
| 6A (Inv.) | Y-10 | I-22 | 0.19 | 77% | 0.19 | 75% |
| 7A (Inv.) | Y-27 | I-27 | 0.20 | 64% | 0.19 | 65% |
| 8A (Comp.) | Y-10 | (a)*6 | 0.28 | 53% | 0.30 | 55% |
| 9A (Comp.) | Y-10 | (b)*6 | 0.25 | 55% | 0.28 | 55% |
| 10A (Inv.) | Y-10 | I-18*7 | 0.18 | 76% | 0.16 | 58% |

*1Stain of an unexposed portion.
*2Residual rate of a yellow density with an initial density of 2.0.
*3Exposed to 200,000 lux for ten days with a xenon tester.
*4Left for standing for eight days at 100° C.
*5Residual rate of a yellow density with an initial density of 1.0.
*6Comparative compounds.
*7I-18 was added also to the third layer in an amount of 50 mole % based on the amount of the magenta coupler.

It can be found from the results summarized in Table C that the samples of the present invention into which the compounds represented by Formula (I) are incorporated demonstrate the excellent effects in the multilayered light-sensitive material, as well as in Examples 1 and 2.

EXAMPLE 4

The samples were prepared in the same manner as Sample No. 101 in Example 1 described in JP-A-2-854, except that the compound (I-2), (I-6), (I-8) or (I-12) of Formula (I) of the present invention was added to the third, fourth and fifth layers, respectively, in a ratio of 25 mole % to the respective couplers with coemulsification.

Further, the samples were prepared in the same manner as Sample No. 101, except that the compound (I-2), (I-6), (I-8) or (I-12) of Formula (I) was added to the twelfth and thirteenth layers, respectively, in a ratio of 25 mole % to the respective couplers with coemulsification.

These samples were subjected to exposure and a development processing and then to a fading test. The measurement of the photographic properties was in the same manner as in Example 1 described in JP-A-2-854 and indicated that the samples of the present invention show an excellent anti-fading effect and the photographic properties are good.

It has been found that the compounds of Formula (I) demonstrate an excellent effect even in such a light-sensitive material.

EXAMPLE 5

The samples were prepared in the same manner as the color photographic light-sensitive material in Example 2 described in JP-A-1-158431, except that Compound (I-2), (I-6), (I-8) or (I-12) of Formula (I) of the present invention was added to the third and fourth layers in an equimolar ratio to the respective couplers.

Further, the samples were prepared in the same manner as the color photographic light-sensitive material in Example 2 described in JP-A-1-158431, except that Cpd-6 contained in the eleventh and twelfth layers was replaced with an equimole of Compound (I-2), (I-6), (I-8) or (I-12) of Formula (I).

These samples were subjected to exposure and a development processing and then to a fading test. The measurement of the photographic properties was done in the same manners as in Example 2 described in JP-A-1-158431 and indicated that the samples of the present invention show an excellent anti-fading effect and the photographic properties also are good.

It has been found that the compounds of the present invention demonstrate an excellent effect even in such light-sensitive materials.

The compound of the present invention represented by Formula (I) shows a superior light fastness effect in comparison with that of previously known anti-fading agents.

While the invention has been described in detail and with reference to specific embodiments thereof, it will be apparent to one skilled in the art that various changes and modifications can be made therein without departing from the spirit and scope thereof.

What is claimed is:

1. A silver halide color photographic light-sensitive material comprising a support having provided thereon at least one layer containing both (i) a yellow coupler and (ii) at least one compound represented by following Formula (I):

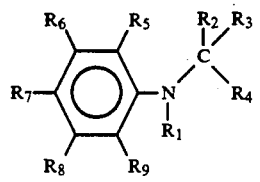

(I)

wherein $R_1$ represents a hydrogen atom, an aliphatic group, an aromatic group, a heterocyclic group, or an aliphatic oxy group; $R_2$ and $R_3$ may be the same or different and each represents an aliphatic group, an aromatic group, or a heterocyclic group; $R_4$ represents a substituent; $R_5$, $R_6$, $R_7$, $R_8$ and $R_9$ each represents a hydrogen atom or a substituent; $R_2$ and $R_3$, $R_3$ and $R_4$, and $R_4$ and $R_2$ may be combined with each other to form a 5- to 8-membered ring; a dimer or other polymer may be formed with $R_1$, $R_2$, $R_3$ and $R_4$; $R_5$ and $R_6$, $R_6$ and $R_7$, $R_7$ and $R_8$, and $R_8$ and $R_9$ may be combined with each other to form a 5- to 8-membered ring; provided that $R_5$, $R_6$, $R_7$, $R_8$ and $R_9$ each does not represent an unsubstituted amino group or an unsubstituted carbamoyl group, $R_5$ and $R_9$ each does not represent an aliphatic oxy group, and any one of $R_2$, $R_3$ and $R_4$ does not form a ring with $R_5$, $R_6$, $R_7$, $R_8$ or $R_9$.

2. The light-sensitive material of claim 1, wherein the yellow coupler is represented by Formula (Y):

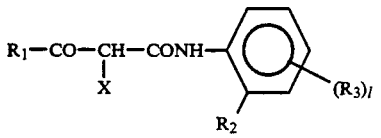

(Y)

wherein $R_1$ represents a tertiary alkyl group, an aryl group, a substituted amino group, or a nitrogen-containing heterocyclic group in which a bonding site is on a nitrogen atom; $R_2$ represents a hydrogen atom, a halogen atom, an alkoxy group, an aryloxy group, an alkyl group, or a dialkylamino group; $R_3$ represents a group which is substitutable on a benzene ring; X represents a hydrogen atom or a group (a splitting off group) capable of splitting off by a coupling reaction with the oxidation product of an aromatic primary amine developing agent; and l represents an integer of 0 to 4, provided that when l is more than one, the plurality of $R_3$ groups may be the same or different.

3. The light-sensitive material of claim 1, wherein $R_1$ in Formula (I) is a hydrogen atom or an aliphatic group.

4. The light-sensitive material of claim 3, wherein $R_1$ in Formula (I) is an alkyl group having 1–20 carbon atoms or an alkenyl group having 2–20 carbon atoms.

5. The light-sensitive material of claim 4, wherein $R_1$ in Formula (I) is an unsubstituted n-alkyl group having 1 to 20 carbon atoms.

6. The light-sensitive material of claim 1, wherein $R_2$ and $R_3$ are each an aliphatic or aromatic group.

7. The light-sensitive material of claim 6, wherein $R_2$ and $R_3$ in Formula (I) are each an alkyl group having 1–20 carbon atoms.

8. The light-sensitive material of claim 7, wherein $R_2$ and $R_3$ in Formula (I) are each an unsubstituted alkyl group having 1 to 9 carbon atoms.

9. The light-sensitive material of claim 1, wherein $R_4$ in Formula (I) is an aliphatic, aliphatic oxycarbonyl, aromatic oxycarbonyl, aliphatic carbamoyl or aromatic carbamoyl group.

10. The light-sensitive material of claim 9, wherein $R_4$ in Formula (I) is an alkyl group having 1 to 18 carbon atoms, an alkyloxycarbonyl group having 2 to 18 carbon atoms or a phenylcarbamoyl group having 6 to 20 carbon atoms.

11. The light-sensitive material of claim 1, wherein $R_7$ in Formula (I) is a hydrogen atom, an aliphatic group, an aliphatic acyloxy group, an aliphatic oxycarbonyl group, an aliphatic thio group, an aromatic thio group, an aliphatic carbamoyl group, an aliphatic sulfonyloxy group, or an aliphatic acylamino group.

12. The light-sensitive material of claim 11, wherein $R_7$ in Formula (I) is a hydrogen atom, an alkyl group or an alkylacylamino group.

13. The light-sensitive material of claim 1, wherein $R_5$, $R_6$, $R_8$ and $R_9$ in Formula (I) are each a hydrogen atom, an aliphatic group, an aliphatic acylamino group, an aromatic acylamino group, an aliphatic oxy group, an aliphatic acyloxy group, an aliphatic sulfonyloxy group, an aliphatic carbamoyl group, a halogen atom, an aliphatic amino group, an aliphatic thio group, an aliphatic oxycarbonyl group, an aromatic thio group, or an aromatic oxy group.

14. The light-sensitive material of claim 1, wherein the compound represented by Formula (I) is used in an amount of 0.5 to 300 mol % based on the amount of the yellow coupler used in the same layer.

* * * * *